US009739126B2

(12) United States Patent
Trautman et al.

(10) Patent No.: US 9,739,126 B2
(45) **Date of Patent: *Aug. 22, 2017**

(54) EFFECTIVE SOLVENT EXTRACTION SYSTEM INCORPORATING ELECTROMAGNETIC HEATING

(71) Applicant: HARRIS CORPORATION, Melbourne, FL (US)

(72) Inventors: Mark Trautman, Melbourne, FL (US); Derik Ehresman, Indialantic, FL (US); Neil Edmunds, Calgary (CA); George Taylor, Renton, WA (US); Mauro Cimolai, Calgary (CA)

(73) Assignee: HARRIS CORPORATION, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/220,510

(22) Filed: Mar. 20, 2014

(65) Prior Publication Data

US 2014/0202686 A1 Jul. 24, 2014

Related U.S. Application Data

(63) Continuation of application No. 14/086,569, filed on Nov. 21, 2013, now Pat. No. 8,776,877, which is a (Continued)

(51) Int. Cl.

| | |
|---|---|
| ***E21B 43/24*** | (2006.01) |
| ***E21B 43/16*** | (2006.01) |
| ***E21B 36/04*** | (2006.01) |

(52) U.S. Cl.

CPC ..... *E21B 43/2408* (2013.01); *E21B 36/04* (2013.01); *E21B 43/16* (2013.01); *E21B 43/24* (2013.01); *E21B 43/2401* (2013.01)

(58) Field of Classification Search
None
See application file for complete search history.

(56) References Cited

U.S. PATENT DOCUMENTS

| | | | |
|---|---|---|---|
| 2,371,459 | A | 3/1945 | Mittelmann |
| 2,685,930 | A | 8/1954 | Albaugh |

(Continued)

FOREIGN PATENT DOCUMENTS

| | | |
|---|---|---|
| CA | 1199573 | 1/1986 |
| CA | 1304287 | 6/1992 |

(Continued)

OTHER PUBLICATIONS

PCT Notification of Transmittal of the International Search Report and the Written Opinion of the International Searching Authority, or the Declaration, in PCT/US2010/025761, dated Feb. 9, 2011, pp. 1-13.

(Continued)

*Primary Examiner* — Anuradha Ahuja
(74) *Attorney, Agent, or Firm* — Allen, Dyer, Doppelt, Milbrath & Gilchrist, P.A. Attorneys at Law

(57) ABSTRACT

A method of producing hydrocarbons from a subterranean reservoir comprises pre-heating by exposure to electromagnetic radiation from a electromagnetic radiation source, injecting through at least one injection well a solvent into the reservoir to dilute the hydrocarbons contained in the preconditioned portion, and producing through at least one production well a mixture of hydrocarbons and solvent. An apparatus for producing hydrocarbons from a subterranean reservoir comprises at least one radio frequency antenna configured to transmit radio frequency energy into a subterranean reservoir, a power source to provide power to the at least one radio frequency antenna, at least one injection well configured to inject a solvent from a solvent supply source into the subterranean reservoir to lower the viscosity of the (Continued)

hydrocarbons, and at least one production well configured to produce a mixture comprising hydrocarbons and solvent from the subterranean reservoir.

36 Claims, 10 Drawing Sheets

Related U.S. Application Data continuation of application No. 12/948,671, filed on Nov. 17, 2010, now Pat. No. 8,616,273.

(56) References Cited

U.S. PATENT DOCUMENTS 3,428,125 A 2/1969 Parker
3,497,005 A 2/1970 Pelopsky
3,503,868 A * 3/1970 Shields ..... 208/429
3,522,842 A 8/1970 New
3,848,671 A 11/1974 Kern
3,954,140 A 5/1976 Hendrick
3,988,036 A 10/1976 Fisher
3,991,091 A 11/1976 Driscoll
4,008,764 A * 2/1977 Allen ..... 166/266
4,035,282 A 7/1977 Stuchberry et al.
4,042,487 A 8/1977 Seguchi
4,087,781 A 5/1978 Grossi et al.
4,136,014 A 1/1979 Vermeulen
4,140,179 A 2/1979 Kasevich et al.
4,140,180 A 2/1979 Bridges et al.
4,144,935 A 3/1979 Bridges
4,146,125 A 3/1979 Sanford et al.
4,196,329 A 4/1980 Rowland et al.
RE30,738 E 9/1981 Bridges et al.
4,295,880 A 10/1981 Horner
4,300,219 A 11/1981 Joyal
4,301,865 A 11/1981 Kasevich et al.
4,328,324 A 5/1982 Kock
4,373,581 A 2/1983 Toellner
4,396,062 A 8/1983 Iskander
4,404,123 A 9/1983 Chu
4,410,216 A 10/1983 Allen
4,425,227 A 1/1984 Smith
4,449,585 A 5/1984 Bridges et al.
4,456,065 A 6/1984 Heim
4,457,365 A 7/1984 Kasevich et al.
4,470,459 A 9/1984 Copland
4,485,869 A 12/1984 Sresty
4,487,257 A 12/1984 Dauphine
4,495,990 A 1/1985 Titus et al.
4,508,168 A 4/1985 Heeren
4,514,305 A 4/1985 Filby
4,524,827 A 6/1985 Bridges
4,531,468 A 7/1985 Simon
4,553,592 A 11/1985 Looney et al.
4,583,586 A 4/1986 Fujimoto et al.
4,620,593 A 11/1986 Haagensen
4,622,496 A 11/1986 Dattili
4,645,585 A 2/1987 White
4,660,636 A 4/1987 Rundell et al.
4,678,034 A 7/1987 Eastlund
4,703,433 A 10/1987 Sharrit
4,790,375 A 12/1988 Bridges
4,817,711 A 4/1989 Jeambey
4,882,984 A 11/1989 Eves, II
4,892,782 A 1/1990 Fisher et al.
5,046,559 A 9/1991 Glandt
5,055,180 A 10/1991 Klaila
5,065,819 A 11/1991 Kasevich
5,082,054 A 1/1992 Kiamanesh
5,136,249 A 8/1992 White
5,199,488 A 4/1993 Kasevich
5,233,306 A 8/1993 Misra
5,236,039 A 8/1993 Edelstein
5,251,700 A 10/1993 Nelson
5,293,936 A 3/1994 Bridges
5,304,767 A 4/1994 MacGaffigan
5,315,561 A 5/1994 Grossi
5,370,477 A 12/1994 Bunin
5,378,879 A 1/1995 Monovoukas
5,506,592 A 4/1996 MacDonald
5,582,854 A 12/1996 Nosaka
5,621,844 A 4/1997 Bridges
5,621,845 A 4/1997 Bridges et al.
5,631,562 A 5/1997 Cram
5,746,909 A 5/1998 Calta
5,910,287 A 6/1999 Cassin
5,923,299 A 7/1999 Brown et al.
6,045,648 A 4/2000 Palmgren et al.
6,046,464 A 4/2000 Schetzina
6,055,213 A 4/2000 Rubbo
6,063,338 A 5/2000 Pham
6,097,262 A 8/2000 Combellack
6,106,895 A 8/2000 Usuki
6,112,273 A 8/2000 Kau
6,184,427 B1 2/2001 Klepfer
6,189,611 B1 2/2001 Kasevich
6,229,603 B1 5/2001 Coassin
6,232,114 B1 5/2001 Coassin
6,301,088 B1 10/2001 Nakada
6,303,021 B2 10/2001 Winter
6,348,679 B1 2/2002 Ryan et al.
6,360,819 B1 3/2002 Vinegar
6,432,365 B1 8/2002 Levin
6,603,309 B2 8/2003 Forgang
6,613,678 B1 9/2003 Sakaguchi
6,614,059 B1 9/2003 Tsujimura
6,649,888 B2 11/2003 Ryan et al.
6,712,136 B2 3/2004 De Rouffignac
6,808,935 B2 10/2004 Levin
6,923,273 B2 8/2005 Terry
6,932,155 B2 8/2005 Vinegar
6,967,589 B1 11/2005 Peters
6,992,630 B2 1/2006 Parsche
7,046,584 B2 5/2006 Sorrells
7,079,081 B2 7/2006 Parsche et al.
7,091,460 B2 8/2006 Kinzer
7,109,457 B2 9/2006 Kinzer
7,115,847 B2 10/2006 Kinzer
7,147,057 B2 12/2006 Steele
7,172,038 B2 2/2007 Terry
7,205,947 B2 4/2007 Parsche
7,312,428 B2 12/2007 Kinzer
7,322,416 B2 1/2008 Burris, II
7,331,385 B2 2/2008 Symington et al.
7,337,980 B2 3/2008 Schaedel
7,438,807 B2 10/2008 Garner et al.
7,441,597 B2 10/2008 Kasevich
7,461,693 B2 12/2008 Considine et al.
7,484,561 B2 2/2009 Bridges
7,562,708 B2 7/2009 Cogliandro
7,623,804 B2 11/2009 Sone
8,371,371 B2 2/2013 Diehl et al.
8,616,273 B2 * 12/2013 Trautman et al. ..... 166/248
8,776,877 B2 * 7/2014 Trautman et al. ..... 166/248
2002/0032534 A1 3/2002 Regier
2004/0031731 A1 2/2004 Honeycutt
2005/0199386 A1 9/2005 Kinzer
2005/0274513 A1 12/2005 Schultz
2006/0038083 A1 2/2006 Criswell
2007/0108202 A1 5/2007 Kinzer
2007/0131591 A1 6/2007 Pringle
2007/0137852 A1 6/2007 Considine et al.
2007/0137858 A1 * 6/2007 Considine et al. ..... 166/248
2007/0187089 A1 8/2007 Bridges
2007/0261844 A1 11/2007 Cogliandro et al.
2008/0073079 A1 3/2008 Tranquilla et al.
2008/0143330 A1 6/2008 Madio
2009/0009410 A1 1/2009 Dolgin et al.
2009/0139716 A1 * 6/2009 Brock et al. ..... 166/272.1
2009/0242196 A1 10/2009 Pao
2010/0294488 A1 11/2010 Wheeler et al.

(56) References Cited

U.S. PATENT DOCUMENTS

| | | | | |
|---|---|---|---|---|
| 2012/0067580 | A1 | 3/2012 | Parsche | |
| 2012/0261129 | A1 | 10/2012 | Becker | |
| 2014/0014324 | A1* | 1/2014 | Wright et al. | 166/248 |

FOREIGN PATENT DOCUMENTS

| | | |
|---|---|---|
| CA | 2678473 | 8/2009 |
| EP | 0135966 | 4/1985 |
| EP | 0418117 | 3/1991 |
| EP | 0563999 | 10/1993 |
| EP | 1106672 | 6/2001 |
| FR | 1586066 | 2/1970 |
| FR | 2925519 | 6/2009 |
| JP | 56050119 | 5/1981 |
| JP | 2246502 | 10/1990 |
| WO | 2007133461 | 11/2007 |
| WO | 2008011412 | 1/2008 |
| WO | 2008030337 | 3/2008 |
| WO | 2008098850 | 8/2008 |
| WO | 2009027262 | 3/2009 |
| WO | 2009114934 | 9/2009 |

OTHER PUBLICATIONS

PCT Notification of Transmittal of the International Search Report and the Written Opinion of the International Searching Authority, or the Declaration, in PCT/US2010/057090, dated Mar. 3, 2011, pp. 1-10.

"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm), pp. 1-13.

Von Hippel, Arthur R., Dielectrics and Waves, Copyright 1954, Library of Congress Catalog Card No. 54-11020, Contents, pp. xi-xii; Chapter II, Section 17, "Polyatomic Molecules", Appendix C-E, New York, John Wiley and Sons, pp. 150-155, pp. 273-277.

United States Patent and Trademark Office, Non-final Office action issued in U.S. Appl. No. 12/396,247, dated Mar. 28, 2011, pp. 1-10.

United States Patent and Trademark Office, Non-final Office action issued in U.S. Appl. No. 12/396,284, dated Apr. 26, 2011, pp. 1-62.

Patent Cooperation Treaty, Notification of Transmittal of the International Search Report and the Written Opinion of the International Searching Authority, or the Declaration, in PCT/US201 0/025808, dated Apr. 5, 2011, pp. 1-12.

Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada, pp. 1-14.

Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers,© 1986, pp. 1-57.

Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers,© 1986. pp. 1-10.

"Oil sands." Wikipedia, the free encyclopedia. Retrieved from the Internet from: http://en.wikipedia.org/w/index.php?title=Oil_sands &printable=yes, Feb. 16, 2009, pp. 1-14.

Sahni et al., "Electromagnetic Heating Methods for Heavy Oil Reservoirs." 2000 Society of Petroleum Engineers SPE/AAPG Western Regional Meeting, Jun. 19-23, 2000, pp. 1-12.

Power et al., "Froth Treatment: Past, Present & Future." Oil Sands Symposium, University of Alberta, May 3-5, 2004, pp. 1-29.

Flint, "Bitumen Recovery Technology A Review of Long Term R&D Opportunities." Jan. 31, 2005. LENEF Consulting (1994) Limited, Part 1, 100 pgs; Part 2, 110 pgs.

"Froth Flotation." Wikipedia, the free encyclopedia. Retrieved from the internet from: http://en.wikipedia.org/wiki/Froth_flotation, Apr. 7, 2009, pp. 1-6.

"Relative static permittivity." Wikipedia, the free encyclopedia. Retrieved from the Internet from http://en.wikipedia.org/w/index/php?title=Relative_static_permittivity&printable=yes, Feb. 12, 2009, pp. 1-3.

"Tailings." Wikipedia, the free encyclopedia. Retrieved from the Internet from http://en.wikipedia.org/w/index.php?title=Tailings &printable=yes, Feb. 12, 2009, pp. 1-6.

"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.

Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045, pp. 1-17.

Sahni et al., "Electromagnetic Heating Methods for Heavy Oil Reservoirs," U.S. Department of Energy, Lawrence Livermore National Laboratory, May 1, 2000, UCL-JC-138802, pp. 1-10.

Abernethy, "Production Increase of Heavy Oils by Electromagnetic Heating," The Journal of Canadian Petroleum Technology, Jul.-Sep. 1976, pp. 91-97.

Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007, pp. 1-9.

Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.

Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.

A. Godio: "Open ended-coaxial Cable Measurements of Saturated Sandy Soils", American Journal of Environmental Sciences, vol. 3, No. 3, 2007, , XP002583544, pp. 175-182.

Carlson et al., "Development of the IIT Research Institute RF Heating Process for In Situ Oil Shale/Tar Sand Fuel Extraction—An Overview", Apr. 1981, pp. 1-9.

PCT International Search Report and Written Opinion in PCT/US2010/025763, Jun. 4, 2010, pp. 1-15.

PCT International Search Report and Written Opinion in PCT/US2010/025807, Jun. 17, 2010, pp. 1-15.

PCT International Search Report and Written Opinion in PCT/US2010/025804, Jun. 30, 2010, pp. 1-15.

PCT International Search Report and Written Opinion in PCT/US2010/025769, Jun. 10, 2010, pp. 1-15.

PCT International Search Report and Written Opinion in PCT/US2010/025765, Jun. 30, 2010, pp. 1-11.

PCT International Search Report and Written Opinion in PCT/US2010/025772, Aug. 9, 2010, pp. 1-16.

Butler, R.M. "Theoretical Studies on the Gravity Drainage of Heavy Oil During In-Situ Steam Heating", Can J. Chern Eng, vol. 59,1981, pp. 1-6.

Butler, R. and Mokrys, 1., "A New Process (VAPEX) for Recovering Heavy Oils Using Hot Water and Hydrocarbon Vapour", Journal of Canadian Petroleum Technology, 30(1 ), 1991, pp. 97-106.

Butler, R. and Mokrys, 1., "Recovery of Heavy Oils Using Vapourized Hydrocarbon Solvents: Further Development of the VAPEX Process", Journal of Canadian Petroleum Technology, 32(6), 1993, pp. 56-62.

Butler, R. and Mokrys, 1., "Closed Loop Extraction Method for the Recovery of Heavy Oils and Bitumens Underlain by Aquifers: the VAPEX Process", Journal of Canadian Petroleum Technology, 37(4), 1998, pp. 41-50.

(56) References Cited

OTHER PUBLICATIONS

Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995, pp. 1-16.
Das, S.K. and Butler, R.M., "Diffusion Coefficients of Propane and Butane in Peace River Bitumen" Canadian Journal of Chemical Engineering, 74,988-989, Dec. 1996 pp. 1-8.
Das, S.K. and Butler, R.M., "Mechanism of the Vapour Extraction Process for Heavy Oil and Bitumen", Journal of Petroleum Science and Engineering, 21, 1998, pp. 43-59.
Dunn, S.G., Nenniger, E. and Rajan, R., "A Study of Bitumen Recovery by Gravity Drainage Using Low Temperature Soluble Gas Injection", Canadian Journal of Chemical Engineering, 67, Dec. 1989, pp. 978-991.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 1998, pp. 17-24.
Mokrys, 1., and Butler, R., "In Situ Upgrading of Heavy Oils and Bitumen by Propane Deasphalting: The VAPEX 11 Process", SPE 25452, presented at the SPE Production Operations Symposium held in Oklahoma City OK USA, D Mar. 21-23, 1993, pp. 1-16.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008, pp. 1-14.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta D Canada, Jun. 16-18, 2009, pp. 1-16.
Bridges, J.E., Sresty, G.C., Spencer, H.L. and Wattenbarger, R.A., "Electromagnetic Stimulation of Heavy Oil Wells", 14, Third International Conference on Heavy Oil Crude and Tar Sands, UNITAR/UNDP, Long Beach D California, USA Jul. 22-31, 1985, pp. 1221-1232.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008, p. 1.
Carrizales, M. and Lake, L.W., "Two-Dimensional COMSOL Simulation of Heavy-Oil Recovery by Electromagnetic Heating", Proceedings of the COMSOL Conference Boston, 2009, pp. 1-7.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992, pp. 1-10.
Chhetri, A.B. and Islam, M.R., "A Critical Review of Electromagnetic Heating for Enhanced Oil Recovery", Petroleum Science and Technology, 26(14), 2008, pp. 1619-1631.
Chute, F.S., Vermeulen, F.E., Cervenan, M.R. and McVea, F.J., "Electrical Properties of Athabasca Oil Sands", Canadian Journal of Earth Science, 16, 1979, pp. 2009-2021.
Davidson, R.J., "Electromagnetic Stimulation of Lloydminster Heavy Oil Reservoirs", Journal of Canadian Petroleum Technology, 34(4), 1995, pp. 15-24.
Hu, Y., Jha, K.N. and Chakma, A., "Heavy-Oil Recovery from Thin Pay Zones by Electromagnetic Heating", Energy Sources, 21(1-2), 1999, pp. 63-73.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994, pp. 1-15.
Koolman, M., Huber, N., Diehl, D. and Wacker, B., "Electromagnetic Heating Method to Improve Steam Assisted /N.B./23 Gravity Drainage", SPE117481, presented at the 2008 SPE International Thermal Operations and Heavy Oil Symposium held in Calgary, Alberta, Canada, Oct. 20-23, 2008, pp. 1-13.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermo Physics, 77(6), 2004, pp. 1184-1191.
McGee, B.C.W. and Donaldson, RD., "Heat Transfer Fundamentals for Electro-thermal Heating of Oil Reservoirs", CIPC 2009-024, presented at the Canadian International Petroleum Conference, held in Calgary, Alberta, Canada, Jun. 16-18, 2009, pp. 1-16.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil D Reservoirs" SPE78980, presented at the 2002 SPE International Thermal Operations and Heavy Oil Symposium and International Horizontal Well Technology Conference held in Calgary, Alberta, Canada, Nov. 4-7, 2002, pp. 1-10.
Rice, S.A., Kok, A.L. and Neate, C.J., "A Test of the Electric Heating Process as a Means of Stimulating the 27 Productivity of an Oil Well in the Schoonebeek Field", CIM 92-04 presented at the CIM 1992 Annual Technical Conference in Calgary, Jun. 7-10, 1992, pp. 1-16.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000, pp. 1-10.
Sayakhov, F.L., Kovaleva, L.A. and Nasyrov, N.M., "Special Features of Heat and Mass Exchange in the Face Zone of /N.B./ 29 Boreholes upon Injection of a Solvent with a Simultaneous Electromagnetic Effect", Journal of Engineering Physics and Thermophysics, 71(1), 1998, pp. 161-165.
Spencer, H.L., Bennett, K.A. and Bridges, J.E. "Application of the IITRI/Uentech Electromagnetic Stimulation Process iN.B.i 30 to Canadian Heavy Oil Reservoirs" Paper 42, Fourth International Conference on Heavy Oil Crude and Tar Sands, UNITARIUNDP, Edmonton, Alberta, Canada, Aug. 7-12, 1988, pp. 1-8.
Sresty, G.C., Dev, H., Snow, R.H. and Bridges, J.E., "Recovery of Bitumen from Tar Sand Deposits with the Radio Frequency Process", SPE Reservoir Engineering, Jan. 1986, pp. 85-94.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 2000, pp. 25-29.
Schelkunoff, S.K. and Friis, H.T., "Antennas: Theory and Practice", John Wiley & Sons, Inc., London, Chapman Hall, Limited, 1952, pp. 229-244, 351-353.
Gupta, S.C., Gittins, S.D., "Effect of Solvent Sequencing and Other Enhancement on Solvent Aided Process", Journal of Canadian Petroleum Technology, vol. 46, No. 9, Sep. 2007, pp. 57-61.
Kinzer, A Review of Notable Intellectual Property for In Situ Electromagnetic Heating of Oil Shale, Quaser Energy LLC, Jan. 10, 2012 (including extracted text).

* cited by examiner

EFFECTIVE SOLVENT EXTRACTION SYSTEM INCORPORATING ELECTROMAGNETIC HEATING

BACKGROUND OF THE INVENTION

Oil sand deposits are found predominantly in the Middle East, Venezuela, and Western Canada. The term "oil sands" refers to large subterranean land forms composed of reservoir rock, water and heavy oil and/or bitumen. The Canadian bitumen deposits, being the largest in the world, are estimated to contain between 1.6 and 2.5 trillion barrels of oil. However, bitumen is a heavy, black oil which, due to its high viscosity, cannot readily be pumped from the ground like other crude oils. Therefore, alternate processing techniques must be used to extract the bitumen deposits from the oil sands, which remain a subject of active development in the field of practice. The basic principle of known extraction processes is to lower the viscosity of the bitumen, typically by the transfer of heat, to thereby promote flow of the bitumen material and recovery of same.

A variety of known extraction processes are commercially used to recover bitumen from oil deposits. Steam-Assisted Gravity Drainage, commonly referred to as SAGD, is one known method. A SAGD process is described, for example, in Canadian patent number 1,304,287. FIG. 1 is a representation of the subsurface arrangement of a typical prior art SAGD system 50. A boiler (not shown) on the surface supplies steam to steam injection piping 14 through connection 12. Steam is injected into subsurface formation 16 at intervals along the length of steam injection piping 14. The steam serves to heat subsurface formation 16, which reduces the viscosity of any hydrocarbons present in subsurface formation 16. Producer piping 18 is configured to accept the hydrocarbons where the hydrocarbons can be pumped to the surface through connection 20 for collection and processing.

The range of temperatures, and corresponding viscosities, required to achieve an economic flow rate is dependent on the hydraulic permeability of the reservoir in question. SAGD, as with most recovery strategies, is focused on increasing bitumen temperature within a limited region around a steam injection well. Once injected, the steam condenses within the bitumen deposit and its latent heat is transferred to the deposit by convection. The reduced-viscosity oil is then allowed to flow by gravity drainage to an underlying point of the reservoir, to be collected by a horizontal production well. The heavy oil/bitumen is then brought to the surface for further processing. Various pumping equipment and/or systems may be used in association with the production well.

Although effective, stand alone SAGD processes have several associated inefficiencies. First, the process is very energy intensive, requiring a great amount of energy for heating the volumes of water needed to generate the steam used for the heat transfer process. In addition, the amount of steam required is usually dictated by the need to maintain a certain pressure in the reservoir; this usually translates into a higher temperature than is optimally needed to mobilize the bitumen and, therefore, the expenditure of unnecessary energy. Further, as indicated above, upon releasing its heat to the formation, the injected steam condenses into water, which mixes with the mobilized bitumen and often leads to additional inefficiencies. For example, the water is generally recycled through boilers and, therefore, this requires costly de-oiling and softening processes/equipment. In addition, the original or initial separation of the bitumen and water requires further processing and costs associated with such procedures. Also, as common with other known active heating methods, significant energy input to the deposit is often transferred to neighboring geological structures and lost by way of conduction. Thus, the process becomes considerably energy intensive in order to achieve sufficient heating of the target formation.

SAGD operating temperature must be at the saturation temperature corresponding to the pore pressure in the reservoir, or the minimum temperature required for economic bitumen drainage rate, whichever is higher. Typical operating temperature is above 200 C. For the SAGD process, saturated steam at approximately 95 percent quality is injected, and saturated liquid water drains out the producer. As a result, neglecting piping and other losses, the ratio of heat delivered to the reservoir to heat required to produce the steam is $$\frac{Qres}{Qsteam} = \frac{xhfg}{hf - hs + xhfg}$$

Where

Qres is the heat delivered to the reservoir

Qsteam is the heat required to produce the steam

X is steam quality, typically 0.95 at the injection point $h_f$ is the enthalpy of saturated liquid at the process temperature and pressure $h_{fg}$ is the latent heat of vaporization $h_a$ is the enthalpy of the water feed to the steam generator The enthalpies vary with the saturation temperature and pressure. For 10% piping losses and a steam generator efficiency of 0.85, then the effective heat conversion efficiency (heat to reservoir divided by heat to steam generator) is 0.85, with heat recovery in both boiler blowdown and produced fluids. Field experience energy consumption for SAGD varies widely. SAGD performance is often measured in terms of SOR (steam oil ratio). As a point of reference for comparison with other processes, numerical predictions for energy consumption at the reservoir for SAGD under favorable conditions (uniform, isotropic hydraulic permeability, typical Athabasca bitumen, 30 m pay zone thickness) varies from 0.9 to 1.25 GJ/bbl heat at the reservoir per bbl bitumen produced. These correspond to SOR at the reservoir of 5 and 3, respectively Dilution is another technique that has been used for the extraction of bitumen from oil sand or heavy oil deposits. The solvent based methods, such as VAPEX (vapor extraction), involve a dilution process wherein solvents, such as light alkanes or other relatively light hydrocarbons, are injected into a deposit to dilute the heavy oil or bitumen. This technique reduces the viscosity of the heavy hydrocarbon component, thereby facilitating recovery of the bitumen-solvent mixture that is mobilized throughout the reservoir. The injected solvent is produced along with bitumen material and some solvent can be recovered by further processing. Although solvent based methods avoid the costs associated with SAGD methods, the production rate of solvent based methods over the range of common in-situ temperatures and pressures has been found to be less than steam based processes. The solvent dilution methods also require processing facilities for the extraction of the injected solvent. Finally, these methods tend to accumulate material quantities of liquid solvent within the depleted part of the reservoir. Such solvents can only partially be recovered at the end of the process thereby representing an economically significant cost for the solvent inventory.

In order to understand the benefits of solvent processes, it is instructive to examine the basic phenomenology of gravity drainage, first developed and quantified for SAGD processes. A simplified representation of SAGD drainage is shown in FIG. 2.

In his landmark paper, Butler (1981) showed that SAGD drainage can be approximated by:

$$Q = \sqrt{\frac{2\phi SoKg\alpha\Delta H}{m\upsilon_s}}$$

Where

Q is the bitumen drainage volume per unit length of well per unit time $\phi$ is porosity So is oil saturation (noted by Butler as actually being change in oil saturation in the zone K is effective permeability for oil flow (a fraction of the total permeability)

g is gravitational acceleration $\alpha$ is the thermal diffusivity of the pay zone $\Delta H$ is the gravitational head (distance from the top of the pay zone to the producer)

m is a dimensionless constant which is dependent upon the conditions used and upon the nature of the heavy oil (bitumen for SAGD applications), and $\upsilon_s$ is the kinematic viscosity of the heavy oil (bitumen as in SAGD applications).

In current practice, flow predictions for given conditions are estimated using reservoir simulator codes that perform numerical analysis of the conditions. However, the driving parameters are as expressed explicitly in the Butler model above which clearly shows that drainage rate is inversely proportional to the square root of the kinematic viscosity. Butler also demonstrated via an energy balance that the rate of advance of the condensation line is governed by the thermal diffusivity of the material as shown in the equation. This represents an additional limitation on the maximum drainage rate of a SAGD process for a given viscosity. The addition of RF heating mitigates the thermal diffusivity rate limitation and thereby reduces the time required for reservoir drainage. Bitumen and heavy oil properties vary over a wide range, but all exhibit an extremely strong variation in viscosity with temperature as exemplified in FIG. 3.

One issue faced in known solvent extraction methods relates to a physical limitation. Bitumen deposits within the Alberta Athabasca region are too cold for the solvent to be commercially effective. At common reservoir temperatures, which are generally in the range of 10-15° C., the solvent dilution process is too slow to be economically viable. For a solvent extraction process to be effective, the bitumen deposit should preferably be at a threshold temperature of 40-70° C.

One solution to address the above problem has been to use steam as a heating means to render the solvent process more efficient. In this regard, a combination of SAGD and VAPEX methods has been proposed in order to combine the benefits of both while mitigating the respective drawbacks. Known as a solvent aided, or solvent assisted process, or SAP, this method involves the injection of both steam and a low molecular weight hydrocarbon into the formation. Gupta et al. (J. Can. Pet. Tech., 2007, 46(9), pp. 57-61) teach a SAP method, which comprises a SAGD process wherein a solvent is simultaneously injected into the formation with the steam. As indicated in this reference, a SAP process has been found to improve the economics of SAGD methods.

However, the above combination of steam and solvent processes has also been found to have disadvantages. As with typical SAGD processes, much of the heat contained in the steam is also lost to the rock and other material bounding the reservoir and is not retained by the bitumen itself. Thus, the energy efficiency of such method is low.

Another solution comprises the use of heated solvent being applied to the reservoir, such as with the N-SOLV™ process. The principle of this process being that the use of heated solvent may raise the temperature of the reservoir to the desired level for an effective dilution process. However, the vapor formed by heating the solvent has a low heat of vaporization, and therefore requires large volumes of solvent to be condensed during condensation to effectively raise the temperature of the bitumen.

Recently, as an alternative to the steam and solvent methods discussed above, another method of producing hydrocarbons from bitumen deposits involves the use of electromagnetic (EM) heating. In this method, one or more antennae are first inserted into the bitumen reservoir. A power transmitter is used to power the antennae, which induces an RF field through the reservoir. The absorbed RF energy heats the water and oil/bitumen within the reservoir, thereby resulting in flow of the hydrocarbon material. A production well is then used to withdraw the mobilized hydrocarbons, similar to the previously discussed methods. One example of an EM process is taught in U.S. Pat. No. 7,441,597, which teaches the use of EM heating to produce heavy oil from a reservoir. In such a process, an antenna is provided in a first horizontal well, and is powered to heat the surrounding heavy oil with RF energy. A second horizontal well is positioned below the first and is used as a production well into which the mobilized heavy oil flows. However, the EM heating method has been found to be very cost intensive, particularly due to the inefficiencies in transferring the generated power to the formation.

Electromagnetic heating uses one or more of three energy forms: electric currents, electric fields, and magnetic fields at radio frequencies. Depending on operating parameters, the heating mechanism may be resistive by Joule effect or dielectric by molecular moment. Resistive heating by Joule effect is often described as electric heating, where electric current flows through a resistive material. The electrical work provides the heat which may be reconciled according to the well known relationships of $P=I^2R$ and $Q=I^2Rt$. Dielectric heating occurs where polar molecules, such as water, change orientation when immersed in an electric field and dielectric heating occurs according to $P=\omega\in_r''\in_0E^2$ and $Q=\omega\in_r''\in_0E^2t$, where P is the power density dissipated in the media, $\omega$ is the angular frequency, $\in_r''$ is the complex component of the material permittivity, $\in_o$ is the permittivity constant of free space, E is the electric field strength, Q is the volumetric heat, and t is time. Magnetic fields also heat electrically conductive materials through the formation of eddy currents, which in turn heat resistively. Thus magnetic fields can provide resistive heating without conductive electrode contact.

Electromagnetic heating can use electrically conductive antennas to function as heating applicators. The antenna is a passive device that converts applied electrical current into oscillating electromagnetic fields, and electrical currents in the target material, without having to heat the structure to a specific threshold level. Preferred antenna shapes can be Euclidian geometries, such as lines and circles. Additional background information on dipole antennas can be found at S. K. Schelkunoff and H. T. Friis, *Antennas: Theory and Practice*, pp 229-244, 351-353 (Wiley New York 1952). The radiation pattern of an antenna can be calculated by taking the Fourier transform of the antenna's electric current flow. Modern techniques for antenna field characterization may employ digital computers and provide for precise RF heat mapping.

Antennas, including antennas for electromagnetic heat application, can provide multiple field zones which are determined by the radius from the antenna r and the electrical wavelength $\lambda$ (lambda). Although there are several names for the zones they can be referred to as a near field zone, a middle field zone, and a far field zone. The near field zone can be within a radius $r<\lambda/2\pi$ (r less than lambda over 2 pi) from the antenna, and it contains both magnetic and electric fields. The near field zone energies are useful for heating hydrocarbon deposits, and the antenna does not need to be in electrically conductive contact with the formation to form the near field heating energies. The middle field zone is of theoretical importance only. The far field zone occurs beyond $r>\lambda/\pi$ (r greater than lambda over pi), is useful for heating hydrocarbon formations, and is especially useful for heating formations when the antenna is contained in a reservoir cavity. In the far field zone, radiation of radio waves occurs and the reservoir cavity walls may be at any distance from the antenna if sufficient energy is applied relative the heating area. Thus, reliable heating of underground formations is possible with radio frequency electromagnetic energy with antennas insulated from and spaced from the formation. The electrical wavelength may be calculated as $\lambda=2\pi/\beta$, where $\beta=\mathrm{Im}(\gamma)$, where $\mathrm{Im}(\gamma)$ indicates the imaginary component of $\gamma$, and $\gamma=(j\omega\mu(\sigma+j\omega\in))^{1/2}$.

Where:

$\lambda$ Is the wavelength;

$\beta$ is the wavenumber;

$\gamma$ is the phase propagation constant;

$\omega$ is the angular frequency;

$\mu$ is the magnetic permeability;

$\sigma$ is the material conductivity; and $\in$ is the material permittivity.

Susceptors are materials that heat in the presence of RF energies. Salt water is a particularly good susceptor for electromagnetic heating; it can respond to all three RF energies: electric currents, electric fields, and magnetic fields. Oil sands and heavy oil formations commonly contain connate liquid water and salt in sufficient quantities to serve as an electromagnetic heating susceptor. "Connate" refers to liquids that were trapped in the pores of sedimentary rocks as they were deposited. For instance, in the Athabasca region of Canada and at 1 kHz frequency, rich oil sand (15 weight percent % bitumen) may have about 0.5-5% water by weight, an electrical conductivity of about 0.01 s/m, and a relative dielectric permittivity of about 120. As bitumen becomes mobile at or below the boiling point of water at reservoir conditions, liquid water may be a used as an electromagnetic heating susceptor during bitumen extraction, permitting well stimulation by the application of RF energy. In general, electromagnetic heating has superior penetration and heating rate compared to conductive heating in hydrocarbon formations. Electromagnetic heating may also have properties of thermal regulation because steam is not an electromagnetic heating susceptor. In other words, once the water is heated sufficiently to vaporize, it is no longer electrically conductive and is not further heated to any substantial degree by continued application of electrical energy.

Heating subsurface heavy oil bearing formations by prior RF systems has been inefficient due to traditional methods of matching the impedances of the power source (transmitter) and the heterogeneous material being heated, uneven heating resulting in unacceptable thermal gradients in heated material, inefficient spacing of electrodes/antennae, excessive electricity usage due to high process temperature, poor electrical coupling to the heated material, limited penetration of material to be heated by energy emitted by prior antennae and frequency of emissions due to antenna forms and frequencies used. Antennas used for prior RF heating of heavy oil in subsurface formations have typically been dipole antennas. U.S. Pat. Nos. 4,140,179 and 4,508,168 disclose dipole antennas positioned within subsurface heavy oil deposits to heat those deposits.

When RF heating is substituted for steam in an otherwise similar extraction process, the heat applied to the reservoir must be less than the SAGD reservoir heat, and the overall RF energy conversion process must be very efficient to achieve energy parity. This is driven by the energy loss associated with electric power generation (for a fossil fuel plant). For example, assume that an RF process requires 53% of the heat applied to the reservoir for the same flow rate as a SAGD process. Assume that system also converts 70% of the input electrical power to RF heat in the reservoir, and that the electric power is provided at 35% efficiency. That system would require 2.2 GJ of heat input to the power station to deliver the same amount of oil as the SAGD system delivering 1 GJ to the reservoir.

As discussed above, several methods are currently known for producing oil from bitumen reservoirs. The common element for all such known methods comprises the reduction in the viscosity of bitumen in the reservoir. Some methods, such as SAGD or N-SOLV™, involve the injection of heated media (water and solvent, respectively) as the heat source. The use of EM heating avoids the use of such heat delivering media. However, known electromagnetic heating methods are typically adapted to completely remove the requirement for any water or solvent from being used (see, for example, in U.S. Pat. No. 7,441,597). And as discussed above, each of these known methods involve several disadvantages, including a high cost.

The recovery of bitumen from reservoirs such as oil sands continues to be of interest particularly in view of the world's increasing energy demand. As such, the need to improve extraction efficiency of hydrocarbon containing reservoirs continues to gain importance. Despite the various prior art attempts discussed above, there exists a need for an efficient and cost-effective method for in situ recovery of bitumen and/or heavy oil from underground reservoirs.

The present system, described herein, stands unique in providing a method wherein EM heating is used initially as a pre-conditioning phase, not to result in production of oil but to increase the temperature of the bitumen, at least within a defined region, to a level where solvent vapor can be used as the final production medium. The solvent achieves this goal by diluting the pre-conditioned, i.e. preheated, bitumen and results in mobility thereof into a production well.

The following references are provided are related to the present subject matter. The entire contents of all references listed in the present specification, including the following documents, are incorporated herein by reference.

Butler, R. M. "Theoretical Studies on the Gravity Drainage of Heavy Oil During In-Situ Steam Heating", Can J. Chem Eng, Vol 59, 1981

REFERENCES RELATING TO SOLVENT INJECTION

Butler, R. and Mokrys, I., "A New Process (VAPEX) for Recovering Heavy Oils Using Hot Water and Hydrocarbon Vapour", *Journal of Canadian Petroleum Technology,* 30(1), 97-106, 1991.

Butler, R. and Mokrys, I., "Recovery of Heavy Oils Using Vapourized Hydrocarbon Solvents: Further Development of the VAPEX Process", *Journal of Canadian Petroleum Technology,* 32(6), 56-62, 1993.

Butler, R. and Mokrys, I., "Closed Loop Extraction Method for the Recovery of Heavy Oils and Bitumens Underlain by Aquifers: the VAPEX Process", *Journal of Canadian Petroleum Technology,* 37(4), 41-50, 1998.

Das, S. K. and Butler, R. M., "Extraction of Heavy Oil and Bitumen Using Solvents at Reservoir Pressure" CIM 95-118, presented at the CIM 1995 Annual Technical Conference in Calgary, June 1995.

Das, S. K. and Butler, R. M., "Diffusion Coefficients of Propane and Butane in Peace River Bitumen" *Canadian Journal of Chemical Engineering,* 74, 988-989, December 1996.

Das, S. K. and Butler, R. M., "Mechanism of the Vapour Extraction Process for Heavy Oil and Bitumen", *Journal of Petroleum Science and Engineering,* 21, 43-59, 1998.

Dunn, S. G., Nenniger, E. and Rajan, R., "A Study of Bitumen Recovery by Gravity Drainage Using Low Temperature Soluble Gas Injection", *Canadian Journal of Chemical Engineering,* 67, 978-991, December 1989.

Frauenfeld, T., Lillico, D., Jossy, C., Vilcsak, G., Rabeeh, S, and Singh, S., "Evaluation of Partially Miscible Processes for Alberta Heavy Oil Reservoirs", *Journal of Canadian Petroleum Technology,* 37(4), 17-24, 1998.

Mokrys, I., and Butler, R., "In Situ Upgrading of Heavy Oils and Bitumen by Propane Deasphalting The VAPEX Process", SPE 25452, presented at the SPE Production Operations Symposium held in Oklahoma City Okla. USA, Mar. 21-23 1993.

Nenniger, J. E. and Dunn, S. G., "How Fast is Solvent Based Gravity Drainage?", CIPC 2008-139, presented at the Canadian International Petroleum Conference, held in Calgary, Alberta Canada, 17-19 Jun. 2008.

Nenniger, J. E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, 16-18 Jun. 2009.

References Relating to Electromagnetic Heating

Bridges, J. E., Sresty, G. C., Spencer, H. L. and Wattenbarger, R. A., "Electromagnetic Stimulation of Heavy Oil Wells", 1221-1232, Third International Conference on Heavy Oil Crude and Tar Sands, UNITAR/UNDP, Long Beach Calif., USA 22-31 Jul. 1985.

Carrizales, M. A., Lake, L. W. and Johns, R. T., "Production Improvement of Heavy Oil Recovery by Using Electromagnetic Heating", SPE115723, presented at the 2008 SPE Annual Technical Conference and Exhibition held in Denver, Colo., USA, 21-24 Sep. 2008.

Carrizales, M. and Lake, L. W., "Two-Dimensional COMSOL Simulation of Heavy-Oil Recovery by Electromagnetic Heating", Proceedings of the COMSOL Conference Boston, 2009.

Chakma, A. and Jha, K. N., "Heavy-Oil Recovery from Thin Pay Zones by Electromagnetic Heating", SPE24817, presented at the 67$^{th}$ Annual Technical Conference and Exhibition of the Society of Petroleum Engineers held in Washington, D.C., Oct. 4-7, 1992.

Chhetri, A. B. and Islam, M. R., "A Critical Review of Electromagnetic Heating for Enhanced Oil Recovery", *Petroleum Science and Technology,* 26(14), 1619-1631, 2008.

Chute, F. S., Vermeulen, F. E., Cervenan, M. R. and McVea, F. J., "Electrical Properties of Athabasca Oil Sands", *Canadian Journal of Earth Science,* 16, 2009-2021, 1979.

Davidson, R. J., "Electromagnetic Stimulation of Lloydminster Heavy Oil Reservoirs", *Journal of Canadian Petroleum Technology,* 34(4), 15-24, 1995.

Hu, Y., Jha, K. N. and Chakma, A., "Heavy-Oil Recovery from Thin Pay Zones by Electromagnetic Heating", *Energy Sources,* 21 (1-2), 63-73, 1999.

Kasevich, R. S., Price, S. L., Faust, D. L. and Fontaine, M. F., "Pilot Testing of a Radio Frequency Heating System for Enhanced Oil Recovery from Diatomaceous Earth", SPE28619, presented at the SPE 69$^{th}$ Annual Technical Conference and Exhibition held in New Orleans La., USA, 25-28 Sep. 1994.

Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, 20-23 Oct. 2008.

Kovaleva, L. A., Nasyrov, N. M. and Khaidar, A. M., "Mathematical Modelling of High-Frequency Electromagnetic Heating of the Bottom-Hole Area of Horizontal Oil Wells, *Journal of Engineering Physics and Thermophysics,* 77(6), 1184-1191, 2004.

McGee, B. C. W. and Donaldson, R. D., "Heat Transfer Fundamentals for Electro-thermal Heating of Oil Reservoirs", CIPC 2009-024, presented at the Canadian International Petroleum Conference, held in Calgary, Alberta, Canada 16-18 Jun. 2009.

Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, 4-7 Nov. 2002.

Rice, S. A., Kok, A. L. and Neate, C. J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.

Sahni, A. and Kumar, M. "Electromagnetic Heating Methods for Heavy Oil Reservoirs", SPE62550, presented at the 2000 SPE/AAPG Western Regional Meeting held in Long Beach, Calif., 19-23 Jun. 2000.

Sayakhov, F. L., Kovaleva, L. A. and Nasyrov, N. M., "Special Features of Heat and Mass Exchange in the Face Zone of Boreholes upon Injection of a Solvent with a Simultaneous Electromagnetic Effect", *Journal of Engineering Physics and Thermophysics,* 71(1), 161-165, 1998.

Spencer, H. L., Bennett, K. A. and Bridges, J. E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, 7-12 Aug. 1988.

Sresty, G. C., Dev, H., Snow, R. H. and Bridges, J. E., "Recovery of Bitumen from Tar Sand Deposits with the Radio Frequency Process", SPE Reservoir Engineering, 85-94, January 1986.

Vermulen, F. and McGee, B. C. W., "In Situ Electromagnetic Heating for Hydrocarbon Recovery and Environmental Remediation", *Journal of Canadian Petroleum Technology*, Distinguished Author Series, 39(8), 25-29, 2000.

SUMMARY OF THE INVENTION

The present system includes a method of producing hydrocarbons from a subterranean reservoir containing the hydrocarbons comprises pre-heating at least a portion of a subterranean reservoir by exposure to electromagnetic radiation from a electromagnetic radiation source, injecting through at least one injection well extending into the subterranean reservoir a solvent into the reservoir to dilute the hydrocarbons contained in the pre-conditioned portion, and producing through at least one production well extending into the subterranean reservoir a mixture of hydrocarbons and solvent.

The method may include pre-heating at least a portion of the subterranean reservoir to about 40° to 70° C. The pre-heated portion of the subterranean reservoir may extend from the electromagnetic radiation source to the production well. The electromagnetic radiation source may comprise at least one radio frequency antenna. The radio frequency antenna(s) may be comprised of production well piping, including injection well piping and/or production well piping.

The present system also includes an apparatus for producing hydrocarbons from a subterranean reservoir containing the hydrocarbons comprises at least one radio frequency antenna configured to transmit radio frequency energy into a subterranean reservoir, the subterranean reservoir containing hydrocarbons, a power source to provide power to the at least one radio frequency antenna, at least one injection well configured to inject a solvent from a solvent supply source into the subterranean reservoir to lower the viscosity of the hydrocarbons, and at least one production well configured to produce a mixture comprising hydrocarbons and solvent from the subterranean reservoir.

The radio frequency antenna(s) may be adapted to generated radio frequency energy at a frequency of about 1 kHz to 1 GHz. The injection well(s) and production well(s) may be generally horizontal. The injection well(s) may be positioned above the production well(s). The injection well(s) and production well(s) may be in the same vertical plane, whereby the injection well(s) are vertically above the production well(s). Further, the radio frequency antenna(s) may include at least one radio frequency antenna comprised of injection well piping and at least one radio frequency antenna comprised of production well piping. The radio frequency antenna(s) may be in close proximity to the least one injection well. The hydrocarbons may comprise heavy oil and/or bitumen.

The method may include operating the radio frequency antenna(s) to control temperature in a region of the subterranean reservoir around the production well to manage asphaltene precipitation. The electromagnetic radiation may have a frequency of about 1 kHz to 1 GHz. The radio frequency antenna(s) may be in close proximity to the least one injection well.

The method may include vaporizing residual solvent in the subterranean reservoir by continued exposure of the subterranean reservoir to electromagnetic radiation after hydrocarbon production, and recovering the vaporized residual solvent. The method may also include recovering residual solvent from the subterranean reservoir after hydrocarbon production by performing a cyclic operation of radio frequency heating and depressurization of the subterranean reservoir.

Other aspects of the invention will be apparent from this disclosure.

DETAILED DESCRIPTION OF THE PREFERRED EMBODIMENTS

Figure 1:
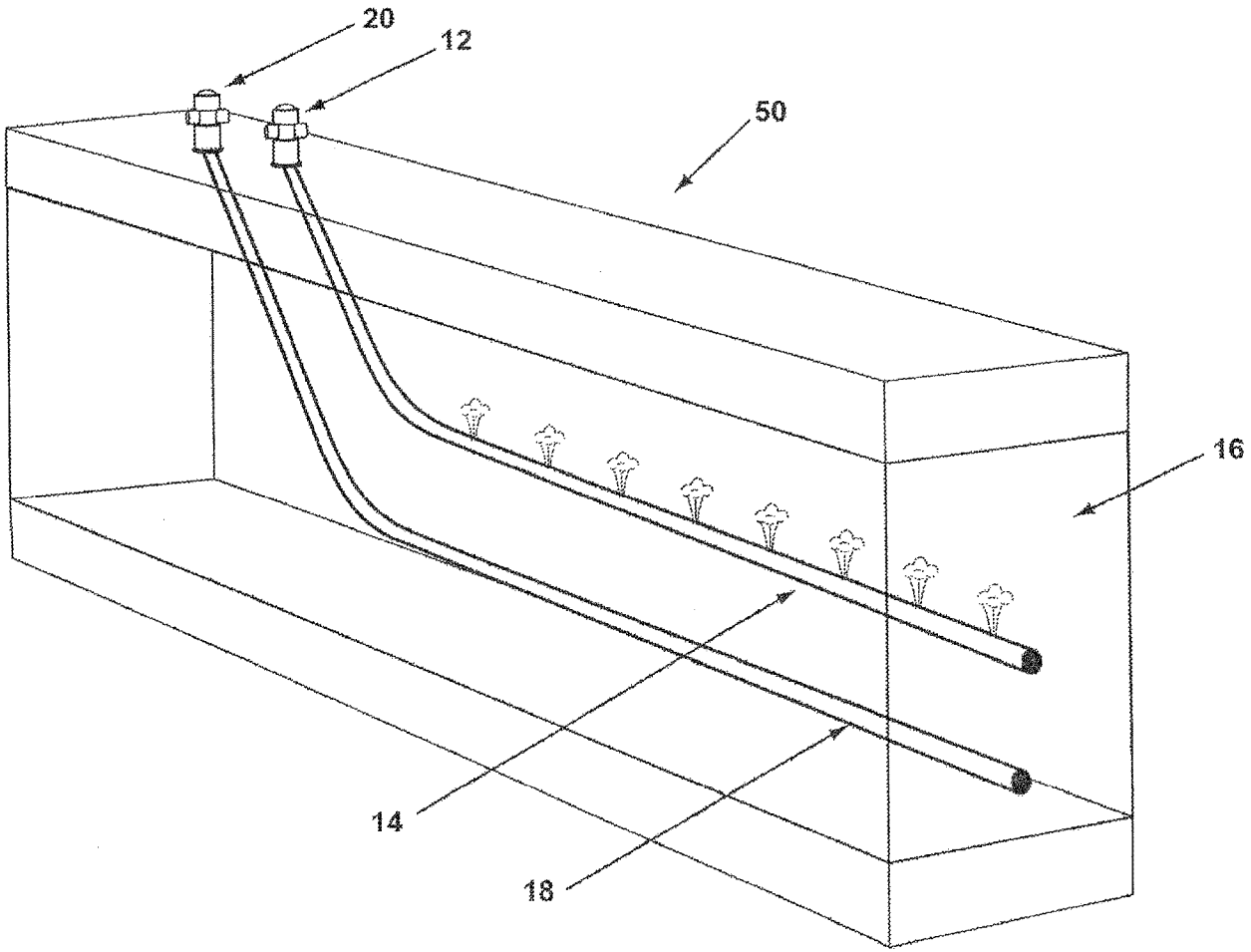
Figure 1 (Prior Art)
FIG. 1 depicts a perspective view of a typical prior art SAGD system.
Figure 2B:
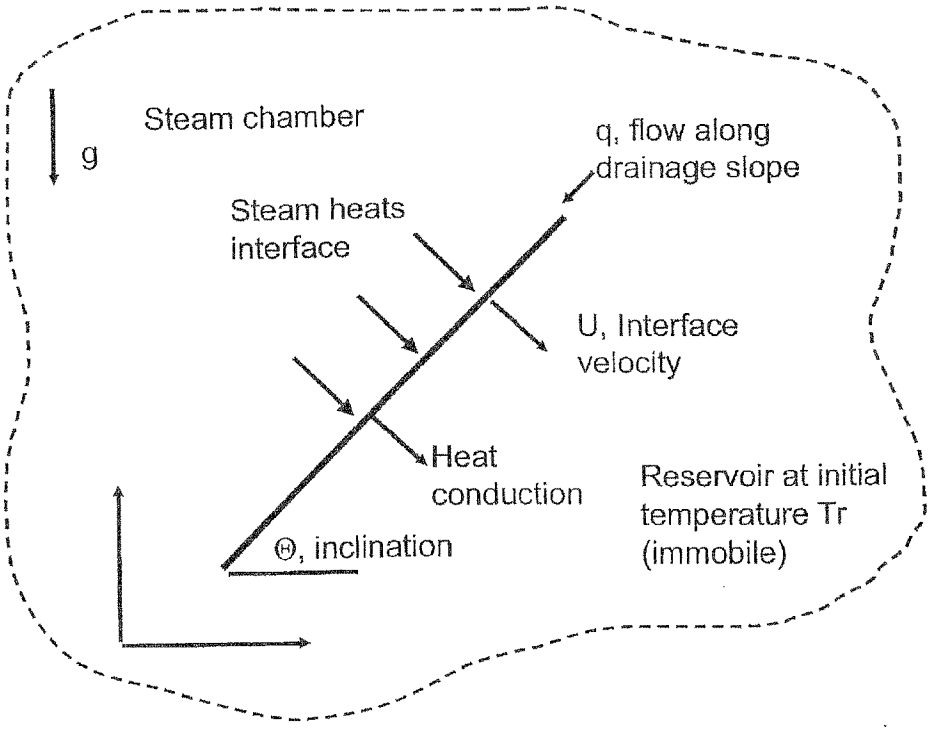
FIG. 2b (Prior Art)
FIG. 2*b* depicts the moving oil interface as hydrocarbon is recovered using the SAGD system.
Figure 2A:
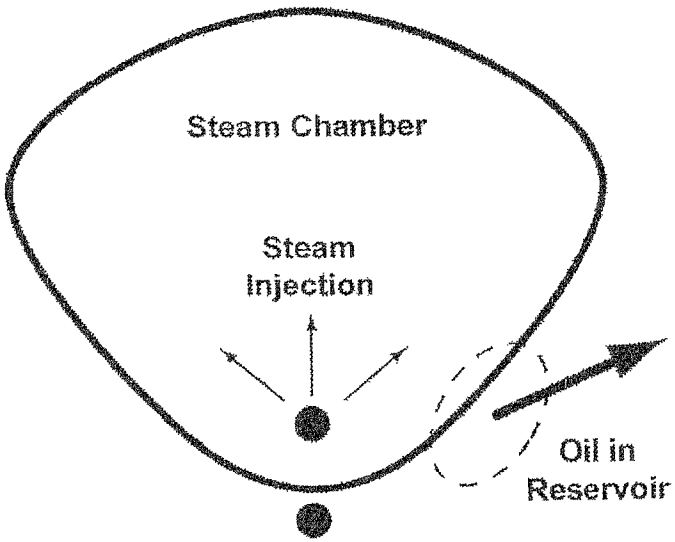
FIG. 2a (Prior Art)
FIG. 2*a* is a schematic depicting a SAGD system in operation.

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

For clarity of understanding, the following terms used in the present description will have the definitions as stated below.

As used herein, the terms "reservoir", "formation", "deposit", are synonymous and refer to generally subterranean reservoirs containing hydrocarbons. As discussed further below, such hydrocarbons may comprise bitumen and bitumen like materials.

"Oil sands", as used herein, refers to deposits containing heavy hydrocarbon components such as bitumen or "heavy oil", wherein such hydrocarbons are intermixed with sand. Although the invention is described herein as being applicable to oil sands, it will be understood by persons skilled in the art that the invention may also be applicable to other types of reservoirs containing bitumen or heavy oil, or other hydrocarbon materials in reservoirs with lower permeability. However, for convenience, the terms "oil sands" and "bitumen" are used for the purposes of the following description and will be understood to refer generally to any of the above mentioned hydrocarbon reservoirs and materials. The choice of such terms serves to facilitate the description of the invention and is not intended to limit the invention in any way.

The term "solvent" refers to one or more hydrocarbon solvents used in hydrocarbon recovery methods as known in the art. In a preferred embodiment, the solvents of the invention are hydrocarbons comprising chain lengths of C2 to C5. The solvent may comprise a mixture of one or more hydrocarbon components. As used herein, the terms "light solvent" or "light hydrocarbon" will be understood as comprising one or more alkane components preferably having a length of C2 to C5, and more preferably C3 (i.e. propane). The light solvent may comprise a mixture of hydrocarbons, each preferably having a length less than C4 and wherein the mixture has an average chain length of approximately C3. In a further preferred aspect, at least ½ v/v of the light solvent mixture is comprised of propane (C3). As known in the art, the choice of solvents depends on the reservoir or anticipated operating pressure The term "natural gas liquids" or "NGL" will be understood as comprising alkane hydrocarbons generally having lengths of C2 to C6, and which are normally condensation products in the course of natural gas processing.

According to an aspect of the present system, there is provided a method of recovering, or producing heavy oils and bitumen, which comprises a unique, coupled combination of electromagnetic (EM) heating and solvent extraction. More specifically, the present system involves a method wherein heavy oil and/or bitumen in a reservoir is heated to a level wherein a solvent extraction process becomes efficient. As discussed above, such native reservoirs are typically at a temperature of 10°-15° C. and a temperature of between 40°-70° C. is required to cause the desired hydrocarbon components to flow at commercial levels with a coupled solvent process.

In general, the present system provides in one aspect, a new in-situ bitumen and heavy oil extraction process that combines EM heating to precondition a heavy oil and/or bitumen reservoir to a desired temperature, preferably between 40° and 70° C. The process may be referred to as Enhanced Solvent Extraction Incorporating Electromagnetic Heating, or "ESEIEH" (pronounced "easy").

According to an aspect of the present system, the aforementioned heating may be achieved through the application of electromagnetic heating via antennae that may be part of the drilling or completion apparatus. When the reservoir reaches the desired temperature within a desired region, an appropriate solvent is then injected into the reservoir. The solvent partially mixes with the oil and further reduces its viscosity and partially displaces the hot-diluted oil. The choice of solvent and well configuration may be similar to existing solvent injection processes. The process also shares similarities with existing electromagnetic heating processes. However, the combination of the two approaches as provided in the present invention is novel and unique, as will be apparent to persons skilled in the art upon reviewing the present description.

According to one aspect, the present system provides a new method and apparatus for the recovery of hydrocarbons from buried hydrocarbon deposits under elevated pressure and low temperature. It has potential application to any heavy oil or bitumen formation that is too deep to mine (i.e. deeper than 100 m). As known in the art, heavy oil is defined as oil with API gravity below 20 and bitumen is described as oil with API gravity below 12. Oil viscosity at reservoir temperatures varies from 100 mPas to 100,000,000 mPas.

In general, a process according to the present system combines the stimulation of the target reservoir with EM heating and its conditioning to minimal temperatures such that the combination of temperature enhanced oil mobility and solvent mixing becomes optimal in achieving commercial extraction rates while minimizing energy requirements in base pre-heating of the oil. At that point a pre-selected solvent is injected. The solvent partially mixes with the oil, making it even less viscous and partially displaces the heated and diluted oil towards a production well. A preferred but not necessary condition of the process is the application of the electromagnetic heating through an antenna that is positioned in a horizontal well that also is used for the injection of solvent. Oil is produced through another horizontal well that is placed in a distance below the injector/heater well, as known in the art from processes such as VAPEX or the well configuration as otherwise applied in SAGD.

In one aspect, the present system eliminates the need for water as an injection fluid and, therefore, the need for generating steam. As such, the present system avoids the significant energy requirements with processes such as SAGD, as well as the commensurate reduction in greenhouse gas emissions. It also reduces the burden on surface facilities to process or separate the oil as it has significantly reduced water content.

Figure 4:
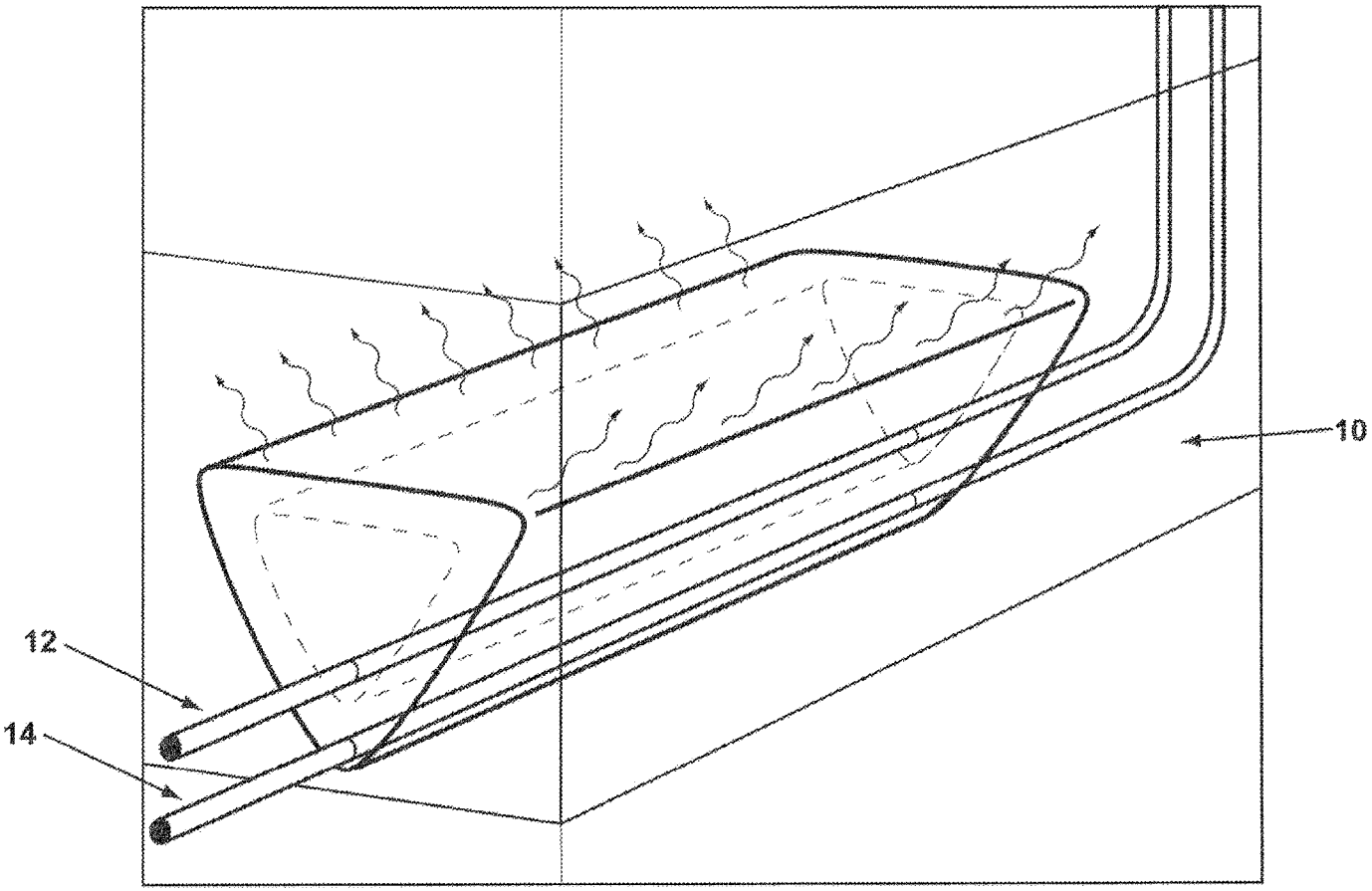
FIG. 4 depicts an ESEIEH process with the injector operating as an antenna.

The present system may comprise several steps. For example, first, a well configuration is provided, which combines wells that will be used as injectors and producers, respectively. The injector wells serve to inject solvent into the reservoir, while the producer wells serve to produce the mobilized heavy oil or bitumen (collectively referred to hereinafter as "bitumen" for convenience, unless otherwise indicated). In a preferred embodiment, the well configuration of the SAGD process is considered, wherein a pair of parallel horizontal wells is drilled, with one well being provided at a deeper depth than the other. The upper well is used as the injector and the lower well as the producer. Such well arrangement is shown in FIG. 4, which illustrates a bitumen containing reservoir 10, as well as an injector well 12 and a production well 14, situated below the injector well. In another, preferred aspect of the invention, the injector well is also used as, or contains within, the antenna for the EM heating. A power transmitter is provided, generally at the surface (i.e. above ground), which may be powered by any power source. The antenna induces a radiofrequency (RF) field and electromagnetically (EM) heats the in-situ water and heavy oil/bitumen via transmission of electrical energy to the reservoir fluids, which results in a greater molecular motion, or heating. In another, preferred embodiment of the present system, both the injector and producer are used as, or contain within, the antennae for the EM heating.

The power transmitter is preferably adapted to power the antenna in a pre-specified, flexible, variable and controllable manner. Such an arrangement allows for dynamic impedance management, frequency of operation and high efficiency coupling of the power source as the physical properties of the formation change as formation properties vary with the removal of produced fluids. The information required for the optimum performance of the antenna comprise the permittivity and impedance changes in the formation as temperature, fluid composition and fluid state in the formation change.

Figure 5:
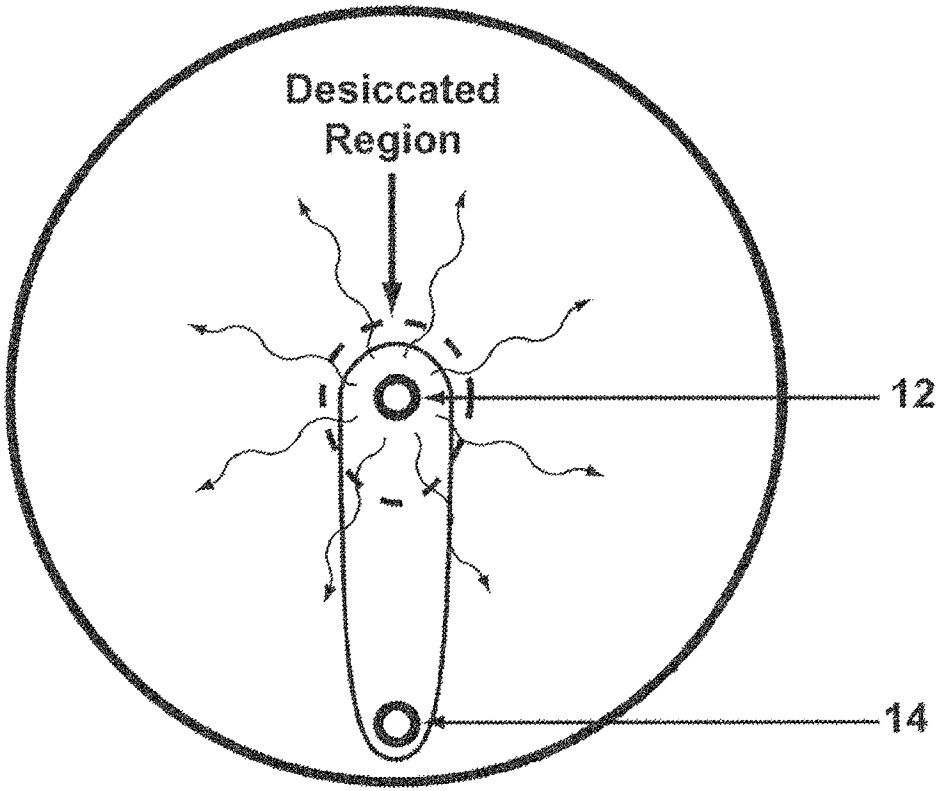
FIG. 5 illustrates initial RF preheating of the reservoir with radio frequency energy to create a mobile zone between the injector and producer.
Figure 6:
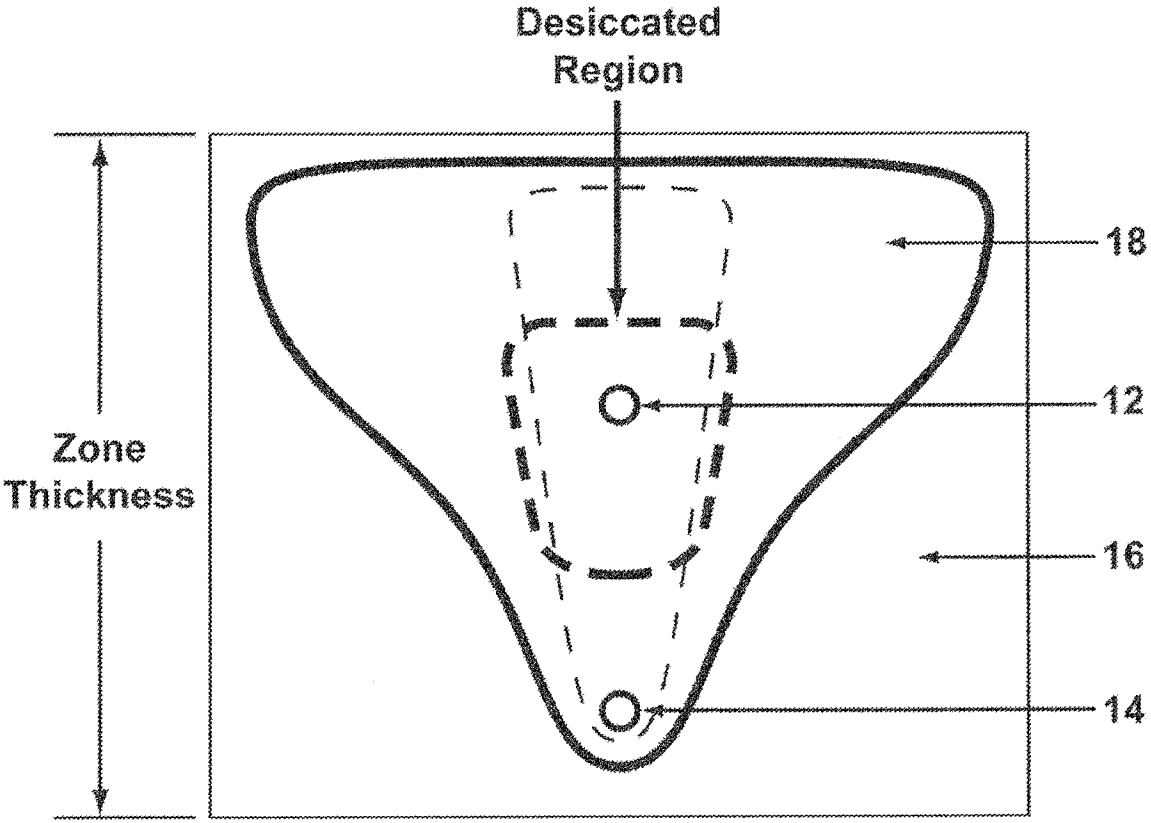
FIG. 6 illustrates the ESEIEH process with a formed solvent chamber.

As illustrated in FIG. 5, the RF-induced heating (or EM heating) initially heats connate water and oil near the antenna. Water and the heated bitumen drain to the producer creating a flow pathway. The flow pathway thus created is then used as the primary conduit to inject a solvent from the antenna/injector well 12. As water is a primary susceptor for electromagnetic heating, the depleted region 11 absorbs less heat from the antenna and this allows more efficient penetration of the electromagnetic heating into the reservoir. The RF heating is applied so as to maintain the reservoir 10 (FIG. 4) temperature at a level that is sufficient to allow efficient application of a solvent extraction process. In a preferred embodiment of the present system, the reservoir is maintained at a temperature of 40-70° C. More preferably, such temperature is maintained at least in the vicinity of the injected solvent, which dissolves the partially heated bitumen. The solvent/bitumen mixture then drains towards the production 14 well at rates that are comparable, or accretive, to SAGD. FIG. 6 illustrates the area of pre-heated bitumen 16, the depletion chamber 18 where recovered oil is extracted. One advantage of the proposed process is the fact that directional RF heating creates zones where the solvent can advance and strip oil in a manner that is expected to be better controlled than conventional VAPEX or its derivatives.

Figure 3:
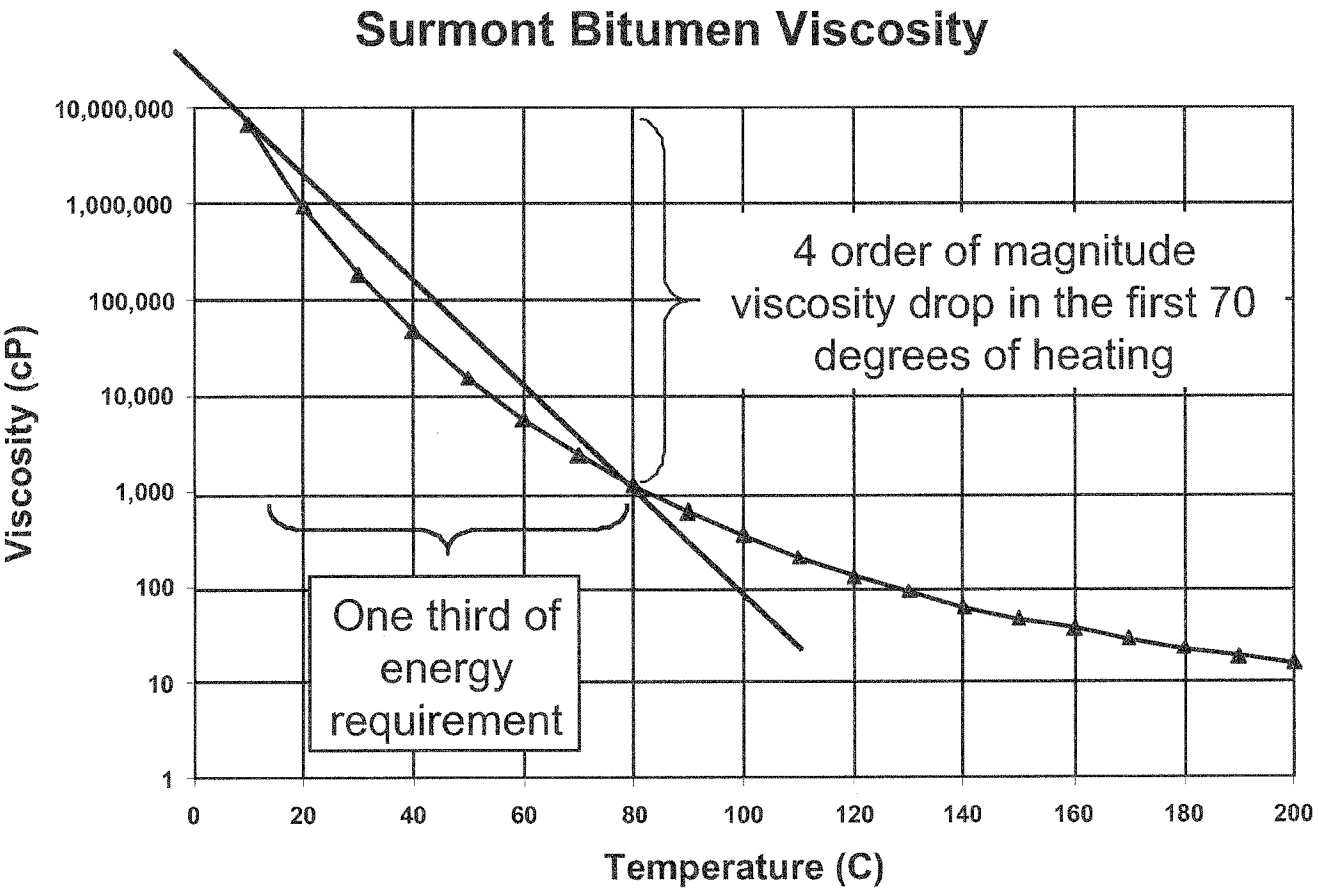
FIG. 3 illustrates bitumen viscosity as a function of temperature.
Figure 7:
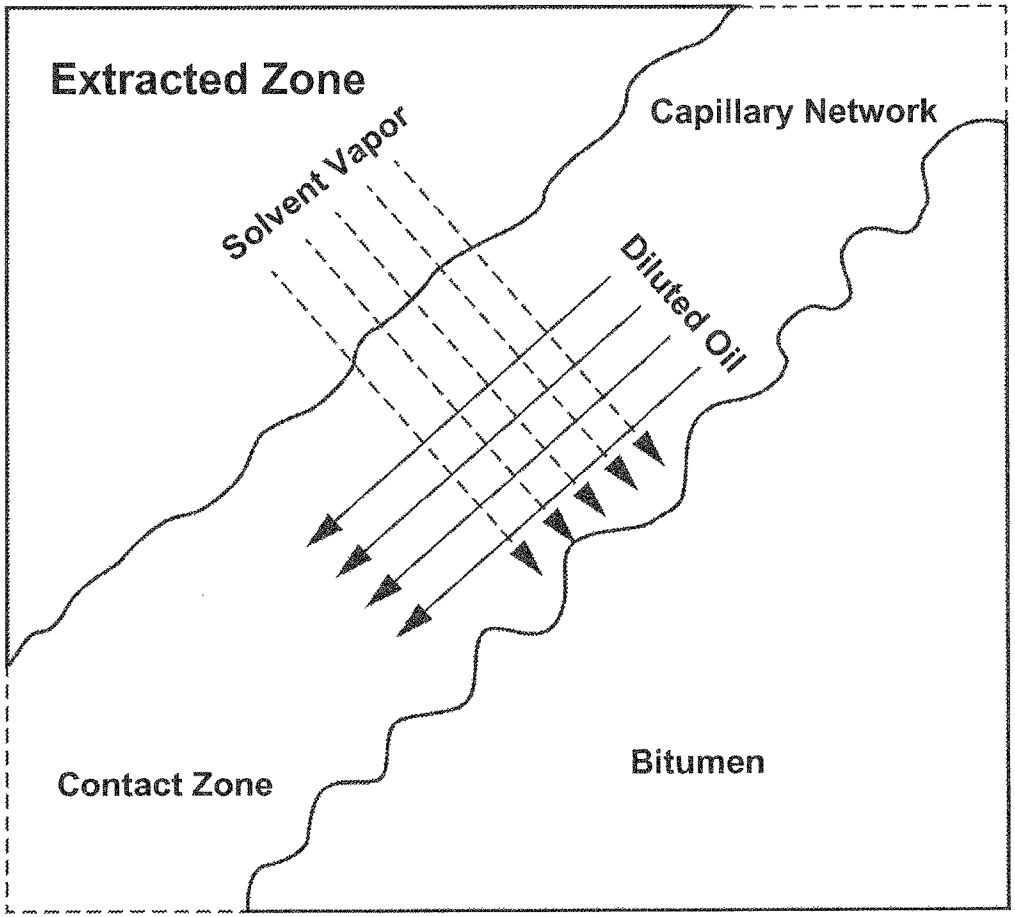
FIG. 7 depicts the solvent-bitumen interface with a mixed region.
Figure 8:
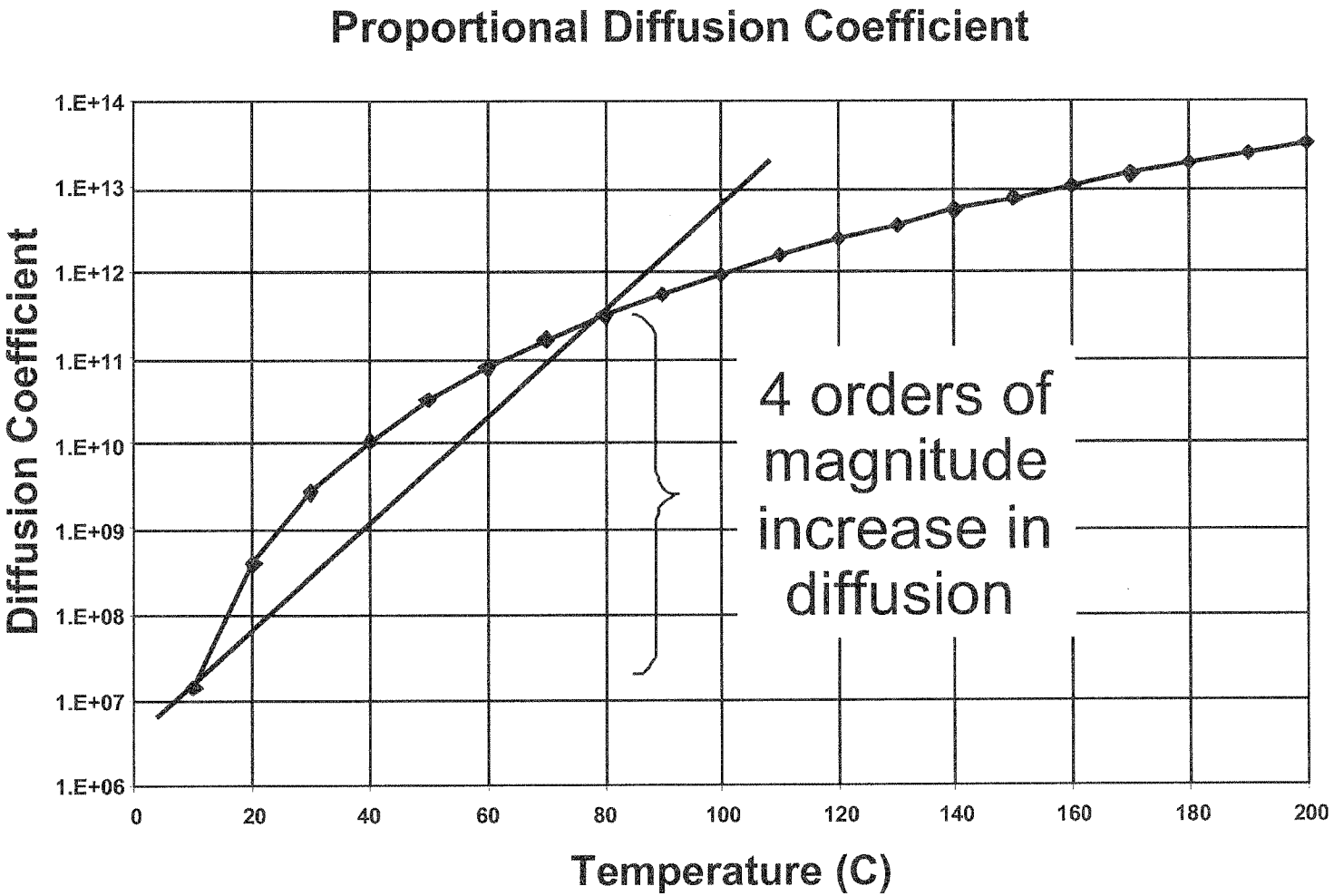
FIG. 8 illustrates the solvent diffusion coefficient as a function of temperature.
Figure 9:
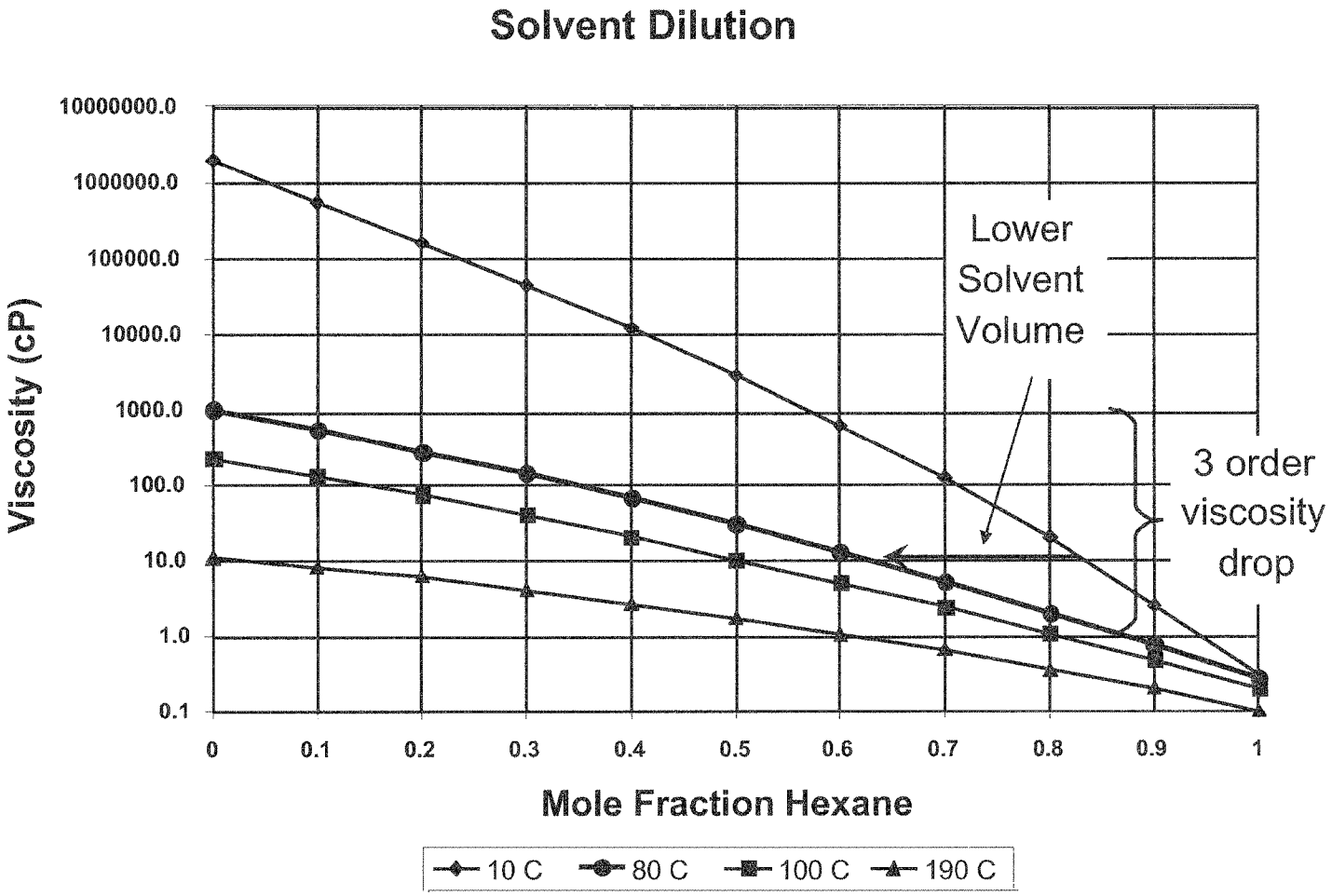
FIG. 9 illustrates the a hexane-hydrocarbon mixture viscosity as a function of hexane mole fraction at several temperatures.

FIG. 7 shows the physical principle of the solvent extraction process. In principle, a solvent vapor comes into contact with bitumen and through diffusion it creates a mobile, dilute bitumen stream which in turn drains towards a production well via gravity. However, with the present system (using the ESEIEH process), directional RF-induced EM heating provides the initial energy to quickly and efficiently heat the bitumen, reducing viscosity by several orders of magnitude while simultaneously increasing the solvent diffusion within the bitumen, while the solvent mixing provides additional oil viscosity reduction to generate threshold and higher commercial rates. Ethane, propane, butane, pentane, or any mixture of the above, or even aromatic solvents can be used. As FIG. 3 indicates by example, heating of bitumen in the vicinity of 80° C. can induce four orders of magnitude in viscosity reduction with only one-third of the energy requirement for conventional SAGD type steam injection. This, coupled with an expected four orders of magnitude increase in diffusion coefficient when increasing the reservoir temperature from 10° C. to approximately 80° C. (see FIG. 8), leads to less solvent requirements for oil/bitumen mobilization (see FIG. 9).

A steam extraction process typically requires about 8 kg of oil sand, heated to a temperature of 100-260° C. to mobilize 1 kg of bitumen. Steam production requires combustion of fuel that could reach up to 30% of the heating value of the bitumen (for an SOR approaching 5), and produces associated greenhouse gas (e.g. $CO_2$) emissions. Introduction of solvents that can produce oil at acceptable rates can potentially reduce energy efficiency and greenhouse gas emissions. In solvent extraction processes, concentration gradients provide the driving force to push solvent into bitumen and mobilize it. Nenniger and Dunn (2008) demonstrate that most of that solvent driving force is consumed within a few microns of the raw bitumen interface in what is referred to as a "concentration shock". This shock arises from the strong dependency of diffusion coefficients on concentration. In the solvent rich phase of the shock, diffusion is very fast, while on the side of the native bitumen shock, diffusion is very slow. This is due to the bitumen viscosity and the fact that the diffusion coefficient is inversely related to the viscosity.

Electromagnetic (EM) heating methods are superior to other energy sources for heating a hydrocarbon reservoir in conjunction with a solvent recovery process. Electromagnetic heating can penetrate energy beyond the solvent chamber-hydrocarbon interface and establish a higher temperature at the interface between solvent and native hydrocarbon compared to a process that relies on heat conduction to transport thermal energy across the dilution zone into the native hydrocarbon. It is worth noting that steam processes rely on heat conduction to deliver heat into the native hydrocarbon beyond the its condensation zone.

Figure 10:
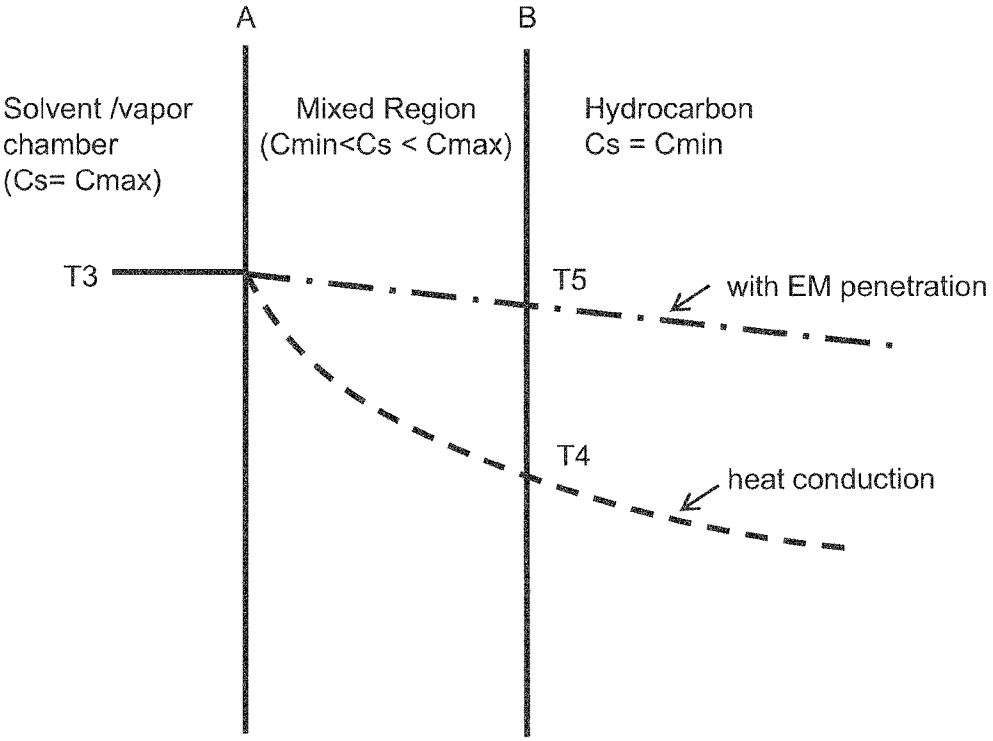
FIG. 10 illustrates temperature profiles at the solvent-hydrocarbon interface.

FIG. 10 shows a schematic of the solvent chamber-hydrocarbon interface during a heated solvent recovery process. In the solvent chamber the solvent concentration Cs is at a maximum and decreases throughout the mixed region. The interface between the solvent chamber and a mixed region of solvent and native hydrocarbons is depicted by line A. The solvent concentration is at a minimum at the interface between the mixed region and the native hydrocarbon depicted by line B, and is essentially zero a short distance into the hydrocarbon. The curved dotted line between interface A and T4 represents an example temperature profile that results from heat conduction (or heat diffusion) into the hydrocarbon. T3 represents the solvent chamber temperature, and T4 is the temperature at interface B that results from heat conduction between interface A and B. The curved dotted line between interface A and T5 represents an example temperature profile that results from electromagnetic heating that penetrates through interface B. T5 represents the temperature at interface B as a result of electromagnetic heating. For the same chamber temperature T3 it is possible to achieve a higher interface B temperature with electromagnetic heating than with any method that relies on heat conduction through the mixed region (T5>T4). This is a direct result of the energy penetration and volumetric heating provided by electromagnetic heating.

The temperature at interface B is of critical importance in a solvent hydrocarbon recovery process because the interface temperature determines the rate at which the hydrocarbon will drain down the interface and be recovered. Higher temperature decreases the viscosity of the native hydrocarbon and subsequently increases the diffusion rate of the solvent into the hydrocarbon. Das and Butler (1996) suggested that the solvent diffusion coefficient D is related to the hydrocarbon viscosity μ by the relation:

$$D=\alpha^{*}\mu^{-b} \text{ where } a,b>0 \qquad \text{equation 1}$$

Because hydrocarbon viscosity is a strong inverse function of temperature, equation 1 indicates that the solvent diffusion coefficient increases dramatically as temperature increases. Furthermore, at a given temperature, a higher solvent concentration Cs in the hydrocarbon produces a lower mixture viscosity. Therefore, increasing the interface temperature has a two-fold effect; it lowers the viscosity of the hydrocarbon which improves the diffusion rate of the solvent into the hydrocarbon, and the resultant increased diffusion produces a critical solvent concentration Cs more quickly within the hydrocarbon resulting in higher hydrocarbon recovery rates compared to other heating methods.

Nenniger and Dunn (2008) showed that for a large number of literature data, the recovered oil mass flux, for solvent based recovery of bitumen, is a function of the bitumen mobility. This correlation can be extended to show that mass flux is proportional to the square root of a characteristic time $tc=k\phi\rho/\mu$, where k is the formation permeability, $\phi$ is the formation porosity, $\rho$ is the oil density and $\mu$ is the oil viscosity. This simple dependency is directly analogous to a diffusion dependency on time for the shock front. Adapting this correlation one can calculate temperature dependent volumetric production rates of shock fronts surrounding horizontal production wells. Since the characteristic time contains terms (density, viscosity) that are temperature dependent, the field rates become equations of the type F(m3/day)=αT(° C.)β where α and β, have to be determined for different reservoirs independently. As an example, for a well of 500 m and a formation of 20 m in thickness with a permeability of 5 D and a bitumen with density at 15° C. of 1.015 g/cm$^3$ and viscosity at 25° C. of 1.3 million cP, the coefficients α and β are of the order of 0.0028 and 2.7924 respectively. As a result, predictions of field flow rates with temperature for this specific system are of the order of the numbers presented in Table 1.

TABLE 1

Expected rates from a solvent based bitumen recovery process

| Temperature, ° C. | Field rate, m$^3$/d |
|---|---|
| 5 | 0.25 |
| 10 | 1.7 |
| 15 | 5.4 |
| 20 | 12.0 |
| 25 | 22.3 |
| 30 | 37.2 |
| 35 | 57.2 |
| 40 | 83.1 |
| 45 | 115.4 |
| 50 | 154.8 |
| 55 | 201.9 |
| 60 | 257.3 |
| 65 | 321.5 |
| 70 | 395.2 |
| 75 | 478.8 |
| 80 | 572.9 |
| 85 | 678.0 |
| 90 | 794.6 |
| 95 | 923.2 |
| 100 | 1064.3 |

Thus with a successful heating of the oil solvent interface, a substantial production rate can be achieved at temperatures substantially below operating steam temperatures. Where the process of the present system differs from condensing solvent processes such as the proposed N-SOLV™ is that the condensing solvent latent heat is not used to introduce the required reservoir fluid heating. As discussed above, the present invention achieves heating using EM (RF-induced) heating. Thus, issues regarding the selection of the solvent associated are not of concern with process of the present invention. For example, the N-SOLV™ process is quite vulnerable to poisoning from non-condensable gases. Sensitivity work by Nenniger et al. (2009) showed that non-condensable gases have a huge impact on the ability of a condensing vapor to deliver heat to the solvent-oil interface. As an inherent advantage, the EM RF heating approach of this invention bypasses this problem.

The present system reduces the energy requirements to recover the hydrocarbons. As Table 1 indicates, oil rates similar to SAGD can be produced at temperatures as low as 40 C, whereas SAGD typically operates above 200 C. Energy consumption is related to the process temperature, and therefore ESEIEH, in this example, uses on the order of 13 percent [(40 C.−10 C.)/(240 C.−10 C.), where the initial reservoir temperature is 10 C.] of the underground energy required by SAGD. This is an oversimplified comparison of the two process but it illustrates the basic thermodynamic principle behind the claimed energy savings.

Residual solvent in the reservoir may constitute a significant volume of material in comparison with the total bitumen removed. Many candidate solvents represent significant commercial value, and reclamation of the residual solvent in that case is a significant factor in total cost of the recovered bitumen. An advantage of the present approach is that the remaining solvent may be recovered by further RF heating to vaporize remaining solvent and recovering the vaporized solvent through the injection, production, or other well, or by reducing the pressure of subsurface geological formation, or by performing a cyclic operation of RF heating and depressurization. The residual solvent may also be reclaimed by cycling a low economic value gas (such as $CO_2$ or $N_2$) through the reservoir Some components of an apparatus according to one aspect of the present system will now be described. As discussed above, the process involves RF-induced heating of the bitumen within a reservoir. Typical tube transducers currently available in the market can operate at frequencies in the range of kHz to GHz. It is envisioned that a commonly available 5 MW output power transmitter is more than sufficient for this process. The transmitters are known to be durable with decades of operating life.

Optimum transmission occurs when transmitter impedance matches the complex conjugate of the load impedance, consisting of the combined antenna and formation impedance. The load impedance range is estimated from measured complex dielectric permittivity of representative samples incorporated in a detail numerical model that estimates the absorbed RF power dissipation as a function of time and position in the formation. The model estimates temperature distribution, and the distribution of gases, water, and bitumen as a function of position and time, with changing power dissipation associated with distributed change in dielectric permittivity. Dielectric permittivity of oil sands is strongly affected by water content and temperature (Chute 1979). The drive point impedance is the ratio of the electric field intensity E divided by the current I at the antenna input. This is a complex quantity, that is typically represented by a Smith chart.

It is important to note that this impedance is a function of the antenna design and resultant electric field distribution throughout the reservoir, and changes with time due to the compositional and temperature changes in the reservoir. Optimum power transfer occurs when the impedance of the power output is the complex conjugate of the drive point impedance. Usually, RF transmitters are designed for a specified output impedance, typically 50 ohms or 75 ohms, although custom impedance values are possible. A matching circuit takes the power output from the transmitter power supply, and delivers it to the drive point with the desired impedance. The matching circuit may be incorporated in the transmitter subsystem, or may be a separate entity. When the impedance match is imperfect, power is reflected back to the transmitter, and is measured via VSWR (variable standing wave ratio) monitoring. Imperfect impedance matching results in loss of coupling quantified by the Power Transfer Theorem taught in innumerable engineering texts.

Moreover, excessive energy reflected into the transmitter can destroy critical internal components. If VSWR exceeds acceptable limits for the transmitter, the transmitter is decoupled from the load to prevent damage. The antenna design and operating frequency is designed to provide effective heating and heat penetration for the material permittivity, while also providing a drive point impedance that is compatible with matching to a transmitter, including the aforementioned range. In operation, drive point impedance change is deduced from reflections analysis and known permittivity behavior. The matching circuit is dynamically changed to maintain high efficiency coupling. There are many embodiments of this process. Given that RF heating of in situ oil sands has been investigated by numerous inventors and none have recognized and quantified this process, development of this system approach is beyond ordinary skills in the art.

Electromagnetic stimulation is documented in the literature. In 1981 the IIT Research Institute conducted two small-scale tests in the oil-sand deposits of Asphalt Ridge, Utah (Sresty et al. 1986). Multiple vertical wells were drilled into a 5-m thick oil sand from just above its outcrop location. Radio-frequency power (at 2.3 MHz increasing to 13.5 MHz) was used to heat the formation to about 160° C. and bitumen was produced by gravity drainage into a sump that had been tunneled below the formation. Another test was conducted four years later to stimulate a well in a 15° API oil reservoir in Oklahoma with reportedly encouraging results (Bridges et al., 1985). Electric heat stimulation of a well producing from the Wildmere Field on the Lloydminster formation in Canada was also reported (Spencer et al., 1988) to cause the well's production rate to increase from 1 $m^3$/d to 2.5 $m^3$/d.

Thus, the present system provides in one aspect, a method for recovering hydrocarbons (i.e. heavy oil and/or bitumen) from a reservoir, or hydrocarbon deposit, comprising the steps of: drilling at least one injection well and at least one production well; providing RF antennas in the injection wells; generating EM radiation through the RF antennae to heat the formation containing the hydrocarbons (preferably, the heating initially extends between the injection wells and the production wells so as to create a "communication pathway" there-between); and injecting a solvent through the injection wells to produce solvent enriched hydrocarbons at the production wells.

The injection and production wells may be horizontal, with the injection wells being above the production wells, generally parallel, or generally in the same vertical plane. The injection wells may be provided as a series of vertical wells, with the production wells provided horizontally and in proximity to the injection wells.

The EM radiation may be used to heat the formation to a temperature of about 40° C. to 70° C. The RF energy is preferably applied at a frequency of about 1 kHz to 1 GHz. The RF antennae may be provided on the injection wells, or provided separate from the injection wells. The RF antennae may also be provided on the injection and producer wells. The duration of heating from each antenna can be controlled to achieve optimum heating rates throughout the process of solvent extraction of hydrocarbons.

The RF power provided may be used to control the temperature at the producer to ensure proper subcool operation (i.e. the producer remains immersed in the hydrocarbon not in the gas). The RF power may also be used to control the solvent/oil ratio in the region of the producer such that asphaltene precipitation that may clog reservoir pores is properly managed. Higher temperature results in a lower solvent/oil ratio and lower probability of asphaltene precipitation, lower temperature results in the converse. The solvent of the present system may be polar. Preferably, the solvent is propane. The injection solvent may be continuously circulated through the hydrocarbon deposit to establish and enlarge solvent vapour chambers to facilitate mobilization and leaching of the heavy oil and/or bitumen.

In FIG. 4, electromagnetic heating antenna and injector 12 and producer 14 may optionally take advantage of the typical horizontal well configuration applied in SAGD, as both processes rely on gravity drainage following the mobilization of reservoir oil. For example, well piping may be used to form an antenna and then serve as a combined electromagnetic heating antenna and injector 12. Such a configuration is fully compatible with capabilities of extant drilling and completion technology, and also extant producer pipe designs that admit bitumen while excluding sand. This is significant in terms of time to field and corollary inventions required to exploit the process in the field. An example of such a configuration is disclosed in U.S. Pat. No. 7,441,597, which is hereby incorporated by reference in its entirety.

The benefits of combined solvent and RF heating may be enhanced for some applications, present or future, with antenna approaches that include but are not limited to those enumerated in Table 2. Preferred antenna shapes can be Euclidian geometries, such as lines and circles. These are fully incorporated in the RF processes described in this submission. The antenna may comprise a system of linear electric conductors situated in the hydrocarbon and conveying electric currents. The antenna macrostructure is preferentially linear in shape as the wells are substantially linear in shape. The time harmonic electric currents transduce one or more of waves, electric fields, magnetic fields, and electric currents into the hydrocarbon which are dissipated there to provide heat. The antennas provide electric circuits may be made open or closed circuit at DC such as dipoles and elongated loops which provide trades in impedance, heating pattern, and installation methods. The energies are transduced according to the Lorentz relation, and other relations, into the surroundings. Transmission lines (not shown) are used between the surface and the hydrocarbon formation to minimize unwanted heating in the overburden.

TABLE 2

Example antenna types that may be used for RF heating

| Antenna Configuration | DC Continuity |
|---|---|
| Dipole | No |
| Monopole | No |
| Loop | Yes |
| Half Loop | Yes |

Although the invention has been described with reference to certain specific embodiments, various modifications thereof will be apparent to those skilled in the art without departing from the purpose and scope of the invention as outlined in the claims appended hereto. Any examples provided herein are included solely for the purpose of illustrating the invention and are not intended to limit the invention in any way. Any drawings provided herein are solely for the purpose of illustrating various aspects of the invention and are not intended to be drawn to scale or to limit the invention in any way.

The invention claimed is:

1. A method of producing hydrocarbons from a subterranean formation comprising:

pre-heating the subterranean formation with at least one radio frequency (RF) antenna;

injecting a hydrocarbon solvent into the pre-heated subterranean formation to form diluted hydrocarbons;

producing the diluted hydrocarbons from the subterranean formation leaving residual hydrocarbon solvent therein; and recovering the residual hydrocarbon solvent, the recovering comprising depressurizing of the subterranean formation after producing the diluted hydrocarbons therefrom, heating the subterranean formation with the at least one RF antenna to vaporize the residual hydrocarbon solvent, and recovering the vaporized residual hydrocarbon solvent via at least one of an injection well and a production well, the depressurizing and the heating of the subterranean formation being performed cyclically.

2. The method of claim 1, wherein the injecting comprises injecting without water.

3. The method of claim 1, wherein the injecting comprises injecting via at least one horizontally extending injection well in the subterranean formation.

4. The method of claim 3, wherein the at least one RF antenna is in the at least one horizontally extending injection well.

5. The method of claim 1, wherein the producing comprises producing via at least one horizontally extending production well in the subterranean formation.

6. The method of claim 5, wherein the at least one RF antenna is in the at least one horizontally extending production well.

7. The method of claim 1, wherein the pre-heating comprises pre-heating at least a portion of the subterranean formation to a temperature in a range of 40 to 70° C.

8. The method of claim 1, wherein the at least one RF antenna is operable in a frequency range of 1 kHz to 1 GHz.

9. The method of claim 1, wherein the hydrocarbons comprise at least one of heavy oil and bitumen.

10. The method of claim 1, wherein the hydrocarbon solvent comprises at least one alkane component having a carbon chain length between 2 and 6.

11. A method of producing hydrocarbons from a subterranean formation comprising:

pre-heating the subterranean formation with at least one radio frequency (RF) antenna;

injecting a hydrocarbon solvent into the pre-heated subterranean formation to form diluted hydrocarbons;

producing the diluted hydrocarbons from the subterranean formation leaving residual hydrocarbon solvent therein;

recovering the residual hydrocarbon solvent, the recovering comprising cycling a gas, different than the hydrocarbon solvent, through the subterranean formation after producing the diluted hydrocarbons therefrom, heating the subterranean formation with the at least one RF antenna to vaporize the residual hydrocarbon solvent, and recovering the vaporized residual hydrocarbon solvent via at least one of an injection well and the production well.

12. The method of claim 11, wherein the gas comprises $CO_2$.

13. The method of claim 11, wherein the gas comprises $N_2$.

14. The method of claim 11, wherein the injecting comprises injecting without water.

15. The method of claim 11, wherein the injecting comprises injecting via at least one horizontally extending injection well in the subterranean formation.

16. The method of claim 15, wherein the at least one RF antenna is in the at least one horizontally extending injection well.

17. The method of claim 11, wherein the producing comprises producing via at least one horizontally extending production well in the subterranean formation.

18. The method of claim 17, wherein the at least one RF antenna is in the at least one horizontally extending production well.

19. The method of claim 11, wherein the pre-heating comprises pre-heating at least a portion of the subterranean formation to a temperature in a range of 40 to 70° C.

20. The method of claim 11, wherein the at least one RF antenna is operable in a frequency range of 1 kHz to 1 GHz.

21. The method of claim 11, wherein the hydrocarbons comprise at least one of heavy oil and bitumen.

22. The method of claim 11, wherein the hydrocarbon solvent comprises at least one alkane component having a carbon chain length between 2 and 6.

23. A method of producing hydrocarbons from a subterranean formation comprising:

heating the subterranean formation with at least one radio frequency (RF) antenna while injecting a hydrocarbon solvent into the subterranean formation to form diluted hydrocarbons;

producing the diluted hydrocarbons from the subterranean formation leaving residual hydrocarbon solvent therein; and recovering the residual hydrocarbon solvent, the recovering comprising depressurizing of the subterranean formation after producing the diluted hydrocarbons therefrom, additionally heating the subterranean formation with the at least one RF antenna to vaporize the residual hydrocarbon solvent, and recovering the vaporized residual hydrocarbon solvent via at least one of an injection well and a production well, the depressurizing and the additional heating of the subterranean formation being performed cyclically.

24. The method of claim 23, wherein the injecting comprises injecting without water.

25. The method of claim 23, wherein the injecting comprises injecting via at least one horizontally extending injection well in the subterranean formation.

26. The method of claim 25, wherein the at least one RF antenna is in the at least one horizontally extending injection well.

27. The method of claim 23, wherein the producing comprises producing via at least one horizontally extending production well in the subterranean formation.

28. The method of claim 27, wherein the at least one RF antenna is in the at least one horizontally extending production well.

29. A method of producing hydrocarbons from a subterranean formation comprising:

heating the subterranean formation with at least one radio frequency (RF) antenna while injecting a hydrocarbon solvent into the subterranean formation to form diluted hydrocarbons;

producing the diluted hydrocarbons from the subterranean formation leaving residual hydrocarbon solvent therein; and recovering the residual hydrocarbon solvent, the recovering comprising cycling a gas, different than the hydrocarbon solvent, through the subterranean formation after producing the diluted hydrocarbons therefrom, heating the subterranean formation with the at least one RF antenna to vaporize the residual hydrocarbon solvent, and recovering the vaporized residual hydrocarbon solvent via at least one of an injection well and a production well.

30. The method of claim 29, wherein the gas comprises $CO_2$.

31. The method of claim 29, wherein the gas comprises $N_2$.

32. The method of claim 29, wherein the injecting comprises injecting without water.

33. The method of claim 29, wherein the injecting comprises injecting via at least one horizontally extending injection well in the subterranean formation.

34. The method of claim 33, wherein the at least one RF antenna is in the at least one horizontally extending injection well.

35. The method of claim 29, wherein the producing comprises producing via at least one horizontally extending production well in the subterranean formation.

36. The method of claim 35, wherein the at least one RF antenna is in the at least one horizontally extending production well.

* * * * *